US009408436B2

(12) United States Patent
Mankowski et al.

(10) Patent No.: US 9,408,436 B2
(45) Date of Patent: Aug. 9, 2016

(54) HEATABLE AND COOLABLE INSERTS FOR FOOTWEAR

(75) Inventors: Michael Mankowski, Portland, OR (US); Jeffrey C. Spanks, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 580 days.

(21) Appl. No.: 13/347,910

(22) Filed: Jan. 11, 2012

(65) Prior Publication Data

US 2013/0174443 A1 Jul. 11, 2013

(51) Int. Cl.

| | |
|---|---|
| ***A43B 19/00*** | (2006.01) |
| ***A43B 7/14*** | (2006.01) |
| ***A43B 7/34*** | (2006.01) |

(52) U.S. Cl.

CPC .. *A43B 19/00* (2013.01); *A43B 7/34* (2013.01)

(58) Field of Classification Search

CPC ..... A43B 19/00; A43B 23/07; A43B 21/28
USPC ..... 36/10, 100, 153, 164, 150; 602/2, 27, 602/13, 14, 28, 30

See application file for complete search history.

(56) References Cited

U.S. PATENT DOCUMENTS

| | | | | |
|---|---|---|---|---|
| 4,183,156 | A | 1/1980 | Rudy | |
| 4,219,945 | A | 9/1980 | Rudy | |
| 4,782,602 | A | 11/1988 | Lakic | |
| 4,823,482 | A | 4/1989 | Lakic | |
| 4,845,338 | A | 7/1989 | Lakic | |
| 5,713,141 | A | 2/1998 | Mitchell et al. | |
| 5,802,740 | A * | 9/1998 | Merk, Sr. | 36/55 |
| 5,921,243 | A * | 7/1999 | Shakoor | 128/882 |
| 5,952,065 | A | 9/1999 | Mitchell et al. | |
| 6,012,726 | A * | 1/2000 | Grande et al. | 280/11.231 |
| 6,013,340 | A | 1/2000 | Bonk et al. | |
| 6,082,025 | A | 7/2000 | Bonk et al. | |
| 6,127,026 | A | 10/2000 | Bonk et al. | |
| 6,203,868 | B1 | 3/2001 | Bonk et al. | |
| 6,226,898 | B1 * | 5/2001 | Trimble et al. | 36/118.2 |
| 6,321,465 | B1 | 11/2001 | Bonk et al. | |
| 6,727,469 | B1 | 4/2004 | Parker et al. | |
| 7,010,872 | B2 * | 3/2006 | Pawlus et al. | 36/100 |
| 7,131,218 | B2 | 11/2006 | Schindler | |
| 7,210,249 | B2 | 5/2007 | Passke et | |
| 7,409,779 | B2 | 8/2008 | Dojan et al. | |
| 7,428,789 | B2 * | 9/2008 | Holzer et al. | 36/88 |
| 7,588,654 | B2 | 9/2009 | Schindler et al. | |
| 7,591,919 | B2 | 9/2009 | Schindler et al. | |

(Continued)

FOREIGN PATENT DOCUMENTS

| | | |
|---|---|---|
| FR | 2825006 | 11/2002 |

OTHER PUBLICATIONS

U.S. Appl. No. 13/049,278, filed Mar. 16, 2011.

(Continued)

*Primary Examiner* — Robert J Hicks
*Assistant Examiner* — Timothy K Trieu
(74) *Attorney, Agent, or Firm* — Plumsea Law Group, LLC

(57) ABSTRACT

An article of footwear may include an insert configured to receive a foot of a wearer. The insert may consist essentially of a casing configured to at least partially enclose a foot of a wearer and including a casing material and a high heat capacity material. The article of footwear may also include an outer assembly configured to receive the foot of the wearer when the foot is received within the insert.

25 Claims, 14 Drawing Sheets

(56) References Cited

U.S. PATENT DOCUMENTS

| | | | | |
|---|---|---|---|---|
| 7,704,273 | B1 | 4/2010 | Morris et al. | |
| 7,806,841 | B2 * | 10/2010 | Caselnova | 602/2 |
| 8,151,486 | B2 | 4/2012 | Dua | |
| 2004/0200094 | A1 * | 10/2004 | Baychar | 36/55 |
| 2005/0096576 | A1 * | 5/2005 | Castro | 602/27 |
| 2007/0062067 | A1 * | 3/2007 | Covatch | 36/55 |
| 2007/0256324 | A1 | 11/2007 | Benfatti | |
| 2007/0271822 | A1 | 11/2007 | Meschter | |
| 2007/0271823 | A1 | 11/2007 | Meschter | |
| 2008/0016715 | A1 | 1/2008 | Vickroy | |
| 2008/0028637 | A1 | 2/2008 | Benfatti | |
| 2009/0100713 | A1 * | 4/2009 | Adami et al. | 36/100 |
| 2009/0288312 | A1 | 11/2009 | Dua | |
| 2009/0288313 | A1 | 11/2009 | Rapaport et al. | |
| 2010/0212183 | A1 | 8/2010 | Seliger et al. | |
| 2011/0131831 | A1 | 6/2011 | Peyton et al. | |
| 2011/0271552 | A1 | 11/2011 | Peyton | |
| 2011/0277347 | A1 | 11/2011 | Monfils et al. | |
| 2011/0277916 | A1 | 11/2011 | Beye et al. | |

OTHER PUBLICATIONS

U.S. Appl. No. 13/049,268, filed Mar. 16, 2011.
U.S. Appl. No. 13/049,256, filed Mar. 16, 2011.

* cited by examiner

HEATABLE AND COOLABLE INSERTS FOR FOOTWEAR

BACKGROUND

The present embodiments relate generally to articles of footwear, and in particular to articles of footwear with heatable and/or coolable inserts.

Articles of footwear generally include two primary elements: an upper and a sole structure. The upper may be formed from a variety of materials that are stitched or adhesively bonded together to form a void within the footwear for comfortably and securely receiving a foot. The sole structure is secured to a lower portion of the upper and is generally positioned between the foot and the ground. In many articles of footwear, including athletic footwear styles, the sole structure often incorporates an insole, a midsole, and an outsole.

In some cases, footwear may include removable inserts that form part of the upper and/or sole structure of the footwear. Systems have been developed that include a footwear outer shell that may include an outer upper material, and at least part of a sole structure, as well as two or more interchangeable inserts. The interchangeable inserts may have differing attributes and, therefore, may be selected according to the performance characteristics of the wearer.

The present disclosure is directed to improvements in interchangeable footwear inserts.

SUMMARY

In one aspect, the present disclosure is directed to an article of footwear. The article of footwear may include an insert configured to receive a foot of a wearer, the insert consisting essentially of a casing configured to at least partially enclose a foot of a wearer and including a casing material and a high heat capacity material. The article of footwear may also include an outer assembly configured to receive the foot of the wearer when the foot is received within the insert.

In another aspect, the present disclosure is directed to a kit of parts. The kit may include an outer assembly including an upper portion and an outer sole portion, the outer assembly configured to receive a foot of a wearer while wearing an insert. The kit may also include a first insert including a first casing configured to at least partially enclose the foot of the wearer. Further, the kit may include a second insert including a second casing configured to at least partially enclose the foot of the wearer, the second casing including a casing material and a high heat capacity material.

In another aspect, the present disclosure is directed to a method of heat transfer between an article of footwear and the foot of a wearer. The method may include providing an outer assembly including an upper portion and an outer sole portion and providing a first insert within the outer assembly, the first insert including a first casing configured to receive the foot of the wearer while disposed within the outer assembly. The method may also include removing the first insert from the outer assembly. Further, the method may include transferring heat to, or from, a second insert using a heat transfer device that is detached from the second insert, wherein the second insert includes a second casing configured to at least partially enclose the foot of the wearer, the second casing including a casing material and a high heat capacity material. Also, the method may include inserting the second insert into the outer assembly and inserting the foot into the second insert while inside the outer assembly.

Other systems, methods, features and advantages of the embodiments will be, or will become, apparent to one of ordinary skill in the art upon examination of the following figures and detailed description. It is intended that all such additional systems, methods, features and advantages be included within this description and this summary, be within the scope of the embodiments, and be protected by the following claims.

BRIEF DESCRIPTION OF THE DRAWINGS

The embodiments can be better understood with reference to the following drawings and description. The components in the figures are not necessarily to scale, emphasis instead being placed upon illustrating the principles of the embodiments. Moreover, in the figures, like reference numerals designate corresponding parts throughout the different views.

DETAILED DESCRIPTION

Figure 1:
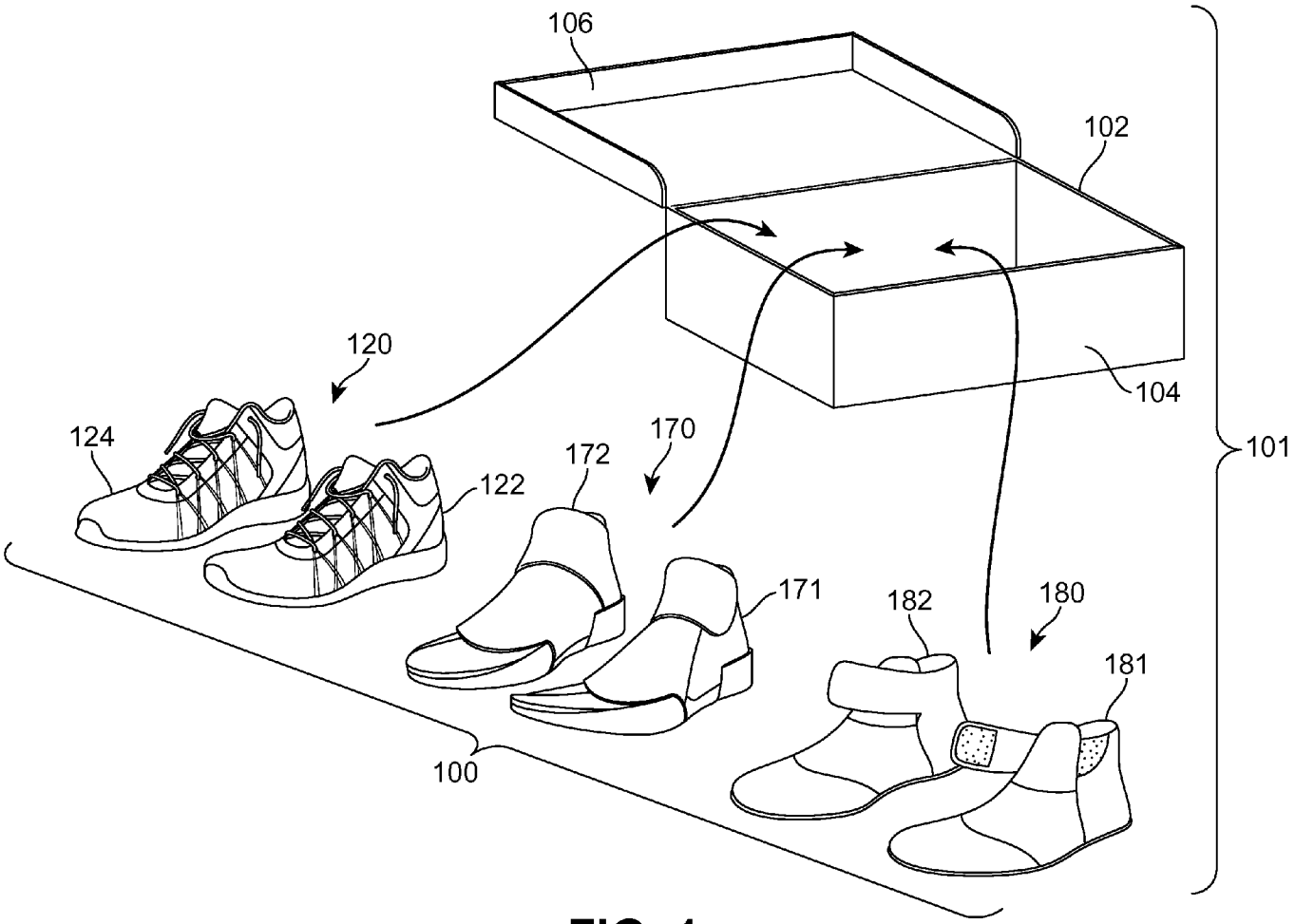
FIG. 1 is a perspective view of an embodiment of a kit of parts including a pair of outer assemblies and two pairs of inserts.

The present disclosure is directed generally to modular articles of footwear, particularly articles of footwear having interchangeable inserts. The following detailed description describes exemplary embodiments of such footwear, including footwear components and kits including such components.

A component associated with an article of footwear may be described by reference to various portions, such as a "forefoot portion", a "midfoot portion", a "heel portion" and an "ankle portion". The forefoot portion may be generally associated with the toes and joints connecting the metatarsals with the phalanges. The midfoot portion may be generally associated with the arch and/or middle of a foot. Likewise, the heel portion may be generally associated with the heel of a foot, including the calcaneus bone. The ankle portion may generally be associated with the ankle of a foot. In addition, an article of footwear and/or insert can also be described by reference to a "lateral side" and a "medial side". The lateral side and medial side may be opposing sides of a component. Furthermore, both the lateral side and the medial side may extend through the forefoot portion, midfoot portion, ankle portion and heel portion.

It will be understood that the terms forefoot portion, midfoot portion, ankle portion, and heel portion are only intended for purposes of description and are not intended to demarcate precise regions of an outer assembly, insert or other footwear component. Likewise, the terms lateral side and medial side are intended to represent generally two sides of a component, rather than precisely demarcating the component into two halves.

For consistency and convenience, directional adjectives are employed throughout this detailed description corresponding to the illustrated embodiments. These terms are used with various components including, but not limited to: an article of footwear, an outer assembly, an upper portion, an outer sole portion, an insert as well as any other components of an article of footwear. The term "longitudinal" as used throughout this detailed description and in the claims refers to a direction extending a length or major axis of a component. In some cases, the longitudinal direction may extend from a forefoot portion to a heel portion of the component. Also, the term "lateral" as used throughout this detailed description and in the claims refers to a direction extending a width or minor axis of a component. In other words, the lateral direction may extend between a medial side and a lateral side of a component. Furthermore, the term "vertical" as used throughout this detailed description and in the claims refers to a direction generally perpendicular to a lateral and longitudinal direction. For example, in cases where an article of footwear is planted flat on a ground surface, the vertical direction may extend from the ground surface upward. In addition, the term "proximal" refers to a portion of a footwear component that is closer to a portion of a foot when an article of footwear is worn. Likewise, the term "distal" refers to a portion of a footwear component that is further from a portion of a foot when an article of footwear is worn.

FIG. 1 illustrates a perspective view of a kit of parts 101, or simply kit 101. In some cases, kit 101 may comprise one or more articles of footwear, accessories for these articles and/or a container for storing the articles. In other cases, kit 101 could include any other provisions not discussed below including, but not limited to: instructions, various kinds of media (such as CDs, DVDs, etc.), additional storage containers for storing articles and/or article accessories as well as any other provisions.

Generally, articles of footwear associated with kit 101 can be any type of footwear. For clarity, the following detailed description discusses articles of footwear in the form of sports shoes, but it should be noted that in other embodiments any other type of footwear could be used including, but not limited to: hiking boots, soccer shoes, football shoes, sneakers, rugby shoes, basketball shoes, baseball shoes as well as other kinds of shoes. Articles of footwear associated with kit 101 may also take the form of any non-athletic shoe, including, but not limited to: dress shoes, loafers, sandals, and boots. An individual skilled in the relevant art will appreciate, therefore, that the disclosed concepts apply to a wide variety of footwear styles, in addition to the specific style discussed in the following material and depicted in the accompanying figures.

Kit 101 may be offered for sale at a retail location, such as a retail store, kiosk, factory outlet, manufacturing store and/or through an online vendor. In some cases, the various parts of kit 101 are sold together. In other cases, however, some parts of kit 101 may be sold separately. As an example, the current embodiment describes a kit of parts including a pair of outer assemblies and two pairs of corresponding inserts. In some cases, a retailer could sell a kit including the footwear and two pairs of inserts and the retailer could also sell one or more pairs of inserts separately from kit 101.

Kit 101 may include container 102. Container 102 can be any type of container configured to store at least one article of footwear. In some cases, container 102 may be a box. In an exemplary embodiment, container 102 may be a shoebox that is configured to store footwear. In particular, container 102 may have a generally rectangular shape and can include lower portion 104 and lid 106. In other embodiments, container 102 could be a bag, sack or other type of container. In still other embodiments, the various items in kit 101 may not be provided in a container.

In some embodiments, kit 101 includes articles of footwear that comprise various interchangeable components. In some cases, kit 101 may include an outer assembly. The term "outer assembly" as used throughout this detailed description and in the claims refers to any outer structure for an article of footwear including, but not limited to, an upper portion as well as an outer sole portion, as described in further detail below. In other embodiments, various other components could also be associated with an outer assembly. Moreover, an outer assembly can be configured to receive one or more inserts, which may be inserted into the outer assembly in order to provide enhanced internal structure.

The term "insert," as used throughout this detailed description and in the claims, refers to any combination of internal components for an article of footwear that can be inserted into an outer assembly. Examples of components that may be incorporated into an insert include, but are not limited to: booties, sleeves, bands, straps, midsole structures, insole structures as well as any other components. In some cases, each insert could be associated with different types of structures in order to allow a user to vary the degree of support, cushioning, flexibility, durability, sensory feedback, including proprioception, as well as any other characteristics of an article of footwear. The term proprioception as used through this detailed description and in the claims refers to the sense of awareness of the relative positions of different parts of the body. Throughout the remainder of this detailed description, the term article of footwear may refer to an outer assembly and/or a combination of an outer assembly with an insert.

In some embodiments, kit 101 includes a pair of outer assemblies 120 that includes first outer assembly 122 and second outer assembly 124. First outer assembly 122 and second outer assembly 124 may be oriented for a left foot and a right foot, respectively. For purposes of clarity, the following detailed description discusses first outer assembly 122, but it will be understood that each of the features discussed for first outer assembly 122 could also apply to second outer assembly 124. Furthermore, first outer assembly 122 may also be referred to as outer assembly 122 throughout the remainder of this detailed description.

In some embodiments, kit 101 can include a first pair of inserts 170 and a second pair of inserts 180. First pair of inserts 170 may include a first insert 171 and a second insert 172 that correspond to first outer assembly 122 and second outer assembly 124, respectively. Second pair of inserts 180 includes first insert 181 and second insert 182 that correspond to first outer assembly 122 and second outer assembly 124, respectively. A user may select a corresponding pair of inserts to use with outer assemblies 120 to form a pair of footwear that may be used in various athletic activities. That is, each outer assembly may be configured to receive a foot of a wearer while wearing an insert.

For purposes of clarity, the following description discusses first insert 171 and first insert 181 in detail. However, it will be understood that second insert 172 may be substantially similar to first insert 171 in many respects. Likewise, it will be understood that second insert 182 may be substantially similar to first insert 181 in many respects. Moreover, throughout the remainder of this detailed description first insert 171 and first insert 181 may be referred to simply as insert 171 and insert 181, respectively.

As shown in FIG. 1, the pair of outer assemblies 120, first pair of inserts 170, and second pair of inserts 180 may be collectively referred to as interchangeable insert system 100. The term interchangeable insert system as used throughout this detailed description and in the claims refers to two or more pairs of removable inserts that can be used with a single pair of outer assemblies to form a pair of footwear. For example, in the embodiment shown in FIG. 1, first insert 171 of first pair of inserts 170 and first insert 181 of second pair of inserts 180 can be used in an interchangeable manner, each with first outer assembly 122. Likewise, second insert 172 of first pair of inserts 170 and second insert 182 of second pair of inserts 180 can be used in an interchangeable manner with second outer assembly 124.

In some embodiments, pair of outer assemblies 120, first pair of inserts 170 and second pair of inserts 180 could be packaged together within container 102 as shown in FIG. 1. However, in other embodiments, other arrangements of outer assemblies 120, inserts 170 and inserts 180 are possible. In some cases, for example, each pair of inserts could be placed in an individual container, such as a cloth bag or plastic box that fits within container 102. In some cases, one pair of inserts may be inserted into outer assemblies 120 while stored in container 102. In still other embodiments, outer assemblies 120 may be packaged separately from inserts 170 and inserts 180, though these components may still be offered for sale together as interchangeable insert system 100.

Although each pair of inserts includes different provisions, as discussed in detail below, they are configured so that either first pair of inserts 170 or second pair of inserts 180 can be used with pair of outer assemblies 120 according to the preference and/or needs of a user. This allows for enhanced versatility for a user, since the combination of an outer assembly with different inserts can provide significant customizability of the characteristics of the footwear.

For example, an interchangeable insert system can include provisions that allow a user to modify various footwear characteristics provided by an article of footwear. The term "footwear characteristics" as used throughout this detailed description and in the claims includes, but is not limited to: support, rigidity, flexibility, cushioning, comfort, proprioception, and energy return, as well as various other kinds of characteristics. In some cases, one type of insert may be configured to provide characteristics that enhance performance in situations where a user may be running or sprinting. For example, an insert can include a midsole with relatively high rigidity that provides a great deal of energy return in a similar manner to a track shoe. In addition, the insert may facilitate proprioception in the midfoot, but little to no feedback at the heel or ankle. This allows a user to receive some sensory information but not too much to be overwhelmed during running or sprinting, where a user may require less foot awareness. In contrast, another insert can be configured to provide footwear characteristics that enhance performance in situations where a user may require increased cushioning and support. In such cases, the insert can include a midsole having a relatively low rigidity to enhance cushioning. In addition, the insert can provide proprioception at the midfoot, heel and ankle portions to enhance awareness of foot position.

Figure 2:
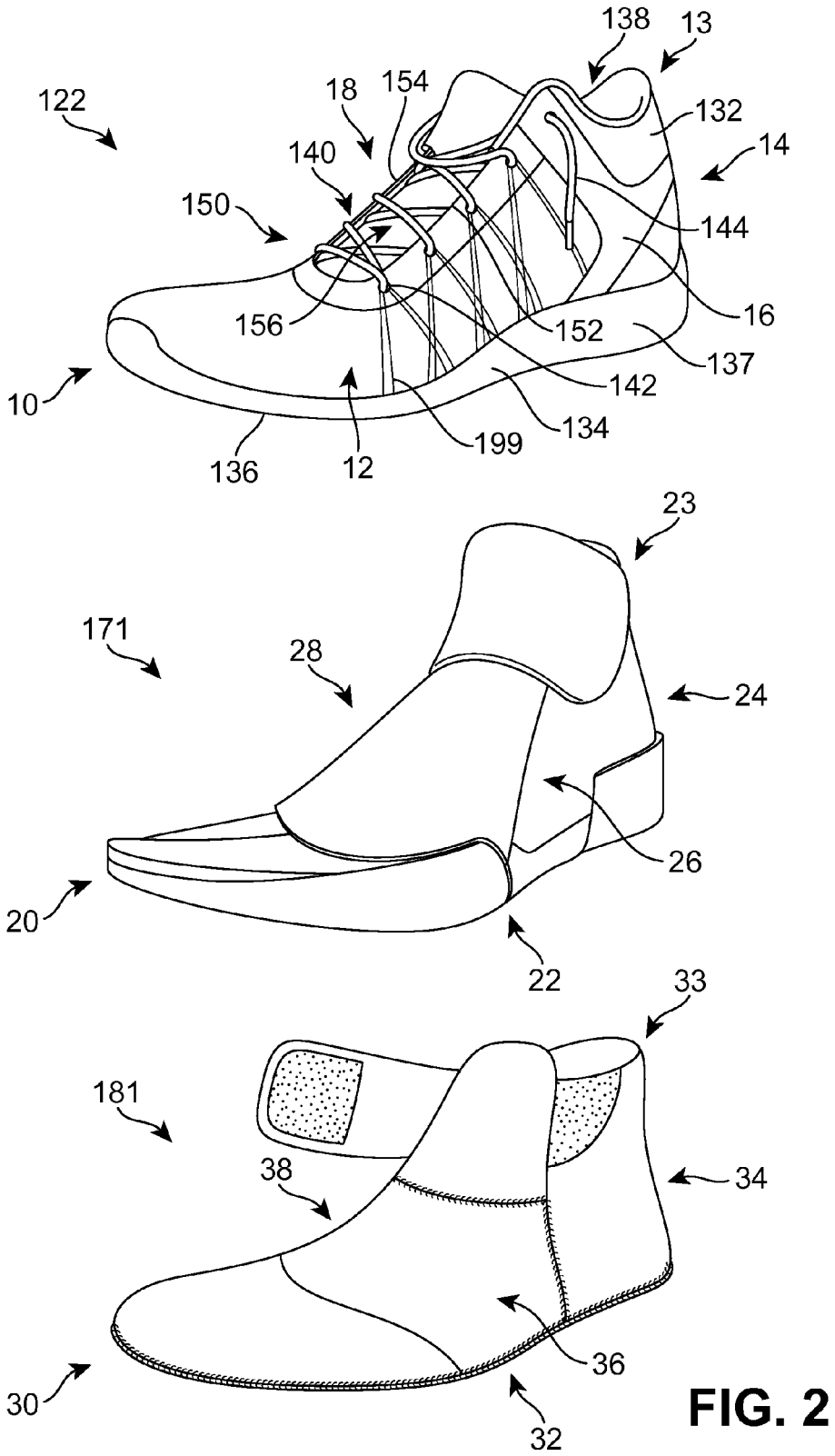
FIG. 2 is a perspective view of an embodiment of an outer assembly and two different inserts.

FIG. 2 illustrates perspective views of some components of kit 101. As shown in FIG. 2, outer assembly 122 can include forefoot portion 10, midfoot portion 12, ankle portion 13 and heel portion 14. Outer assembly 122 can also include lateral side 16 and medial side 18. In addition, insert 171 can include forefoot portion 20, midfoot portion 22, ankle portion 23 and heel portion 24, as well as lateral side 26 and medial side 28. Likewise, insert 181 includes forefoot portion 30, midfoot portion 32, ankle portion 33, and heel portion 34, as well as lateral side 36 and medial side 38.

Further, as shown in FIG. 2, outer assembly 122 can include an upper portion 132. In some cases, upper portion 132 may be substantially similar to uppers found in some other kinds of footwear. For example, upper portion 132 can include opening 138 that provides entry for a foot into an interior cavity of upper portion 132. In some cases, opening 138 may be disposed at the ankle region of upper portion 132. However, in other cases, opening 138 could be disposed in any other region of upper portion 132. Additionally, the size of opening 138 may be controlled using fastening system 140.

Generally, upper portion 132 could have any design, shape, size and/or color. For example, in embodiments where kit 101 provides components for a basketball shoe, upper portion 132 could be configured as a high top upper that is shaped to provide high support on an ankle. In embodiments where kit 101 provides components for a running shoe, upper portion 132 could be configured as a low top upper. In the current embodiment, upper portion 132 may be configured as a mid-top type upper that can be used in basketball shoes as well as other types of footwear.

In one embodiment, fastening region 150 of upper portion 132 includes first fastening edge 152 and second fastening edge 154 that are separated by gap 156. In embodiments where fastening system 140 is a lacing system, first fastening edge 152 and second fastening edge 154 can include plurality of eyelets 142 for receiving lace 144. Using this arrangement, as lace 144 is tightened, upper portion 132 may be tightened around a foot. Although the current embodiment uses a lacing system, in other embodiments fastening system 140 could make use of any other kinds of fasteners for footwear including, but not limited to: zippers, button, snaps, straps, cords as well as any other fasteners known in the art for fastening footwear.

In contrast to some kinds of uppers, in some cases, upper portion 132 may not include a tongue. Instead, a tongue or tongue like portion can be provided on one or more inserts so that the properties of a tongue for an article of footwear can be varied. In such embodiments, portions of an insert could be visible through gap 156. In other embodiments, however, upper portion 132 could include a tongue.

In addition to a fastening system, in other embodiments, upper portion 132 could include various other provisions to enhance the structural properties of upper 132 as well as to add aesthetic features. In one embodiment, for example, upper 132 could be provided with one or more threaded structures that extend from eyelets 142 and towards the bottom of upper portion 132. Articles with threads configured to provide structural support have been previously disclosed in U.S. Patent Application Publication No. 2007/0271822, to Meschter, the entirety of which is hereby incorporated by reference. In addition, U.S. Patent Application Publication No. 2007/0271823, also to Meschter, is hereby incorporated by reference. In some embodiments, upper portion 132 may include threaded structures 199 that extend from eyelets 142 towards an outer sole portion 134 of outer assembly 122, as shown in FIG. 2.

In some embodiments, outer sole portion 134 may be configured to provide traction for outer assembly 122. In addition to providing traction, outer sole portion 134 may be configured to attenuate ground reaction forces when compressed between the foot and the ground during walking, running or other ambulatory activities. The configuration of outer sole portion 134 may vary significantly in different embodiments to include a variety of conventional or non-conventional structures. In some cases, the configuration of outer sole portion 134 can be arranged according to one or more types of ground surfaces on which outer sole portion 134 may be used. Examples of ground surfaces include, but are not limited to: natural turf, synthetic turf, dirt, as well as other surfaces.

In different embodiments, outer sole portion 134 may include different components. For example, in some embodiments, outer sole portion 134 may include an outsole, a midsole, and/or an insole. In some embodiments, outer sole portion 134 could comprise a shell like outsole portion that receives a midsole and/or insole. For example, in one embodiment, outer sole portion 134 can include outsole 136 that extends along the bottom of outer assembly 122 and engages a ground surface. Moreover, outer sole portion 134 can include outer sidewall portions 137 that enclose an interior portion of outer sole portion 134.

Performance Insert

Figure 3:
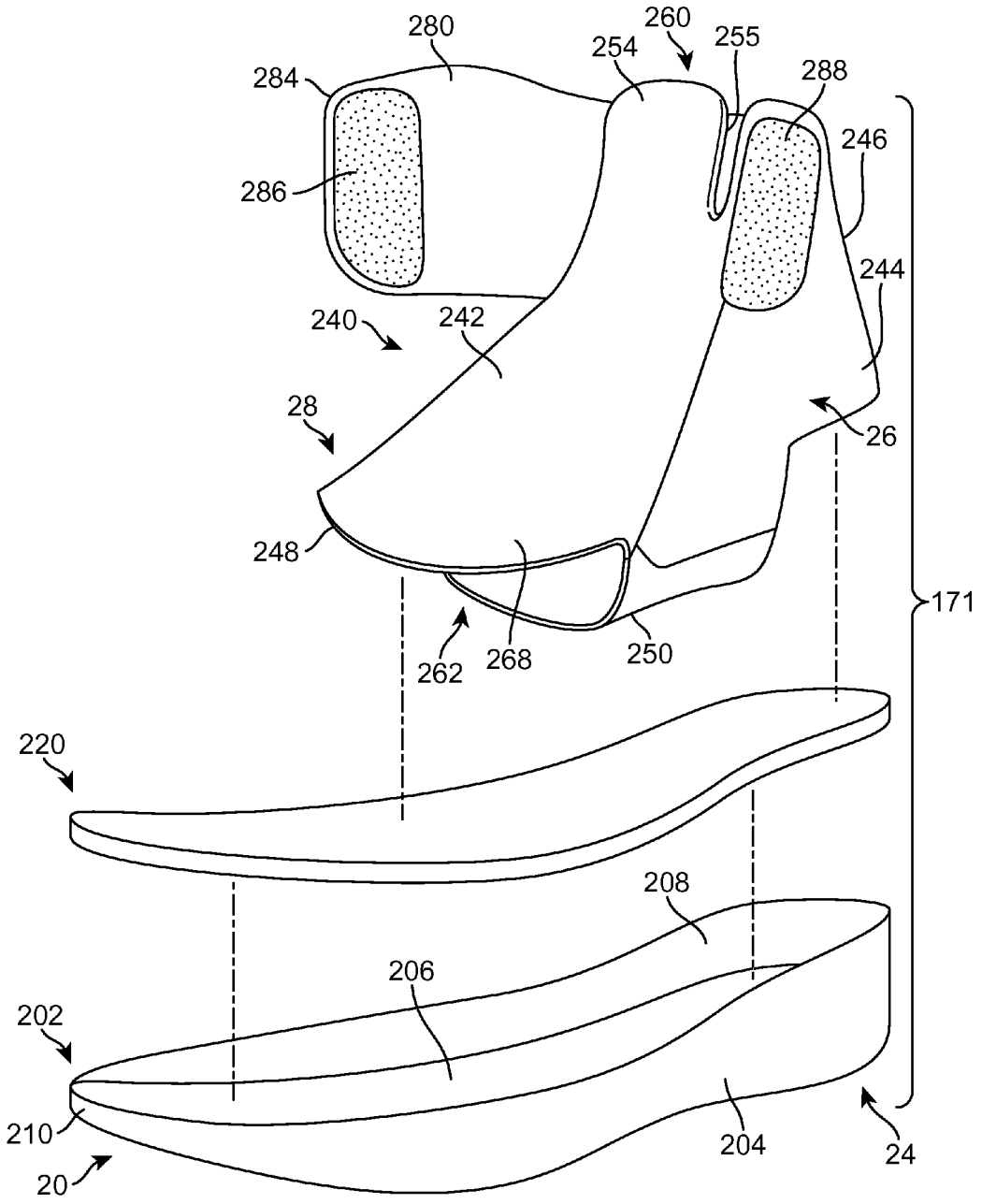
FIG. 3 is an exploded perspective view of an embodiment of an insert.
Figure 4:
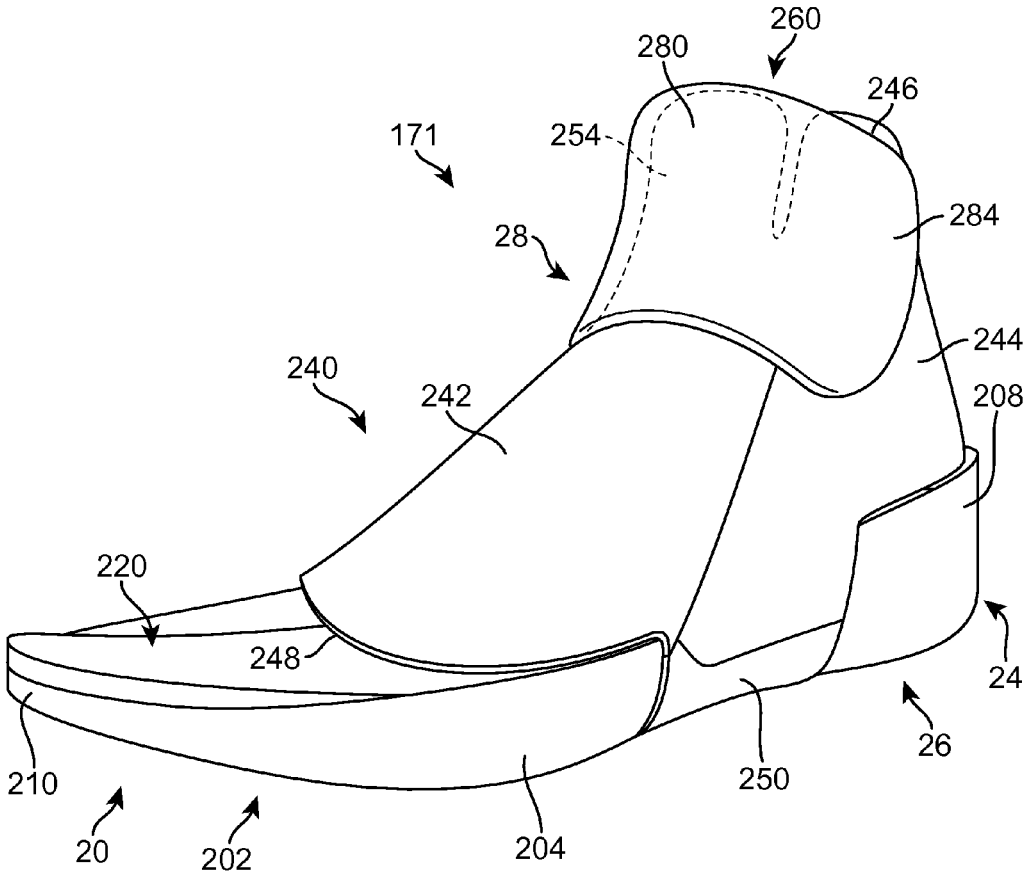
FIG. 4 is a assembled perspective view of an embodiment of an insert.
Figure 5:
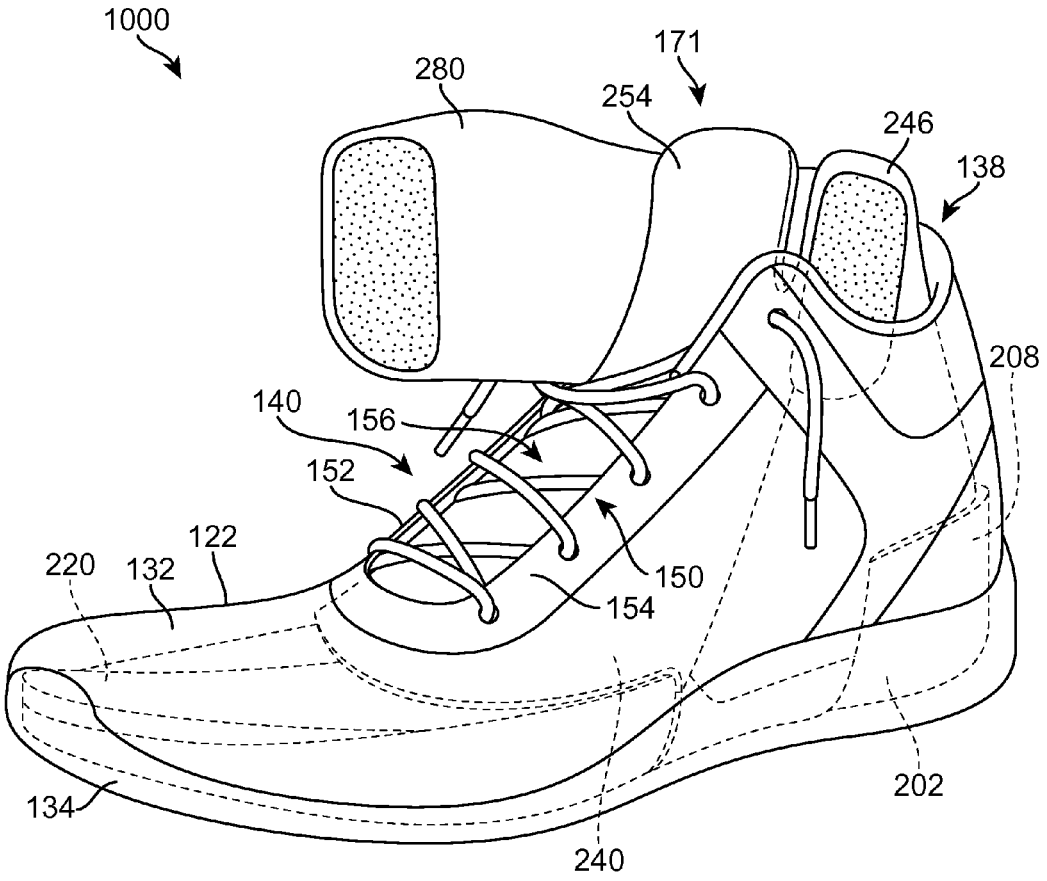
FIG. 5 is a perspective view of an embodiment of an insert inserted into an outer assembly with the fastening system of the outer assembly unfastened and a fastening member of the insert unfastened.

FIGS. 3 through 5 illustrate lateral perspective views of an embodiment of insert 171. Insert 171 may be a performance insert, which may be configured, for example, for athletic performance. For instance, insert 171 may be configured to provide various footwear characteristics that may be desired for various activities, such characteristics including, for example, cushioning, support, comfort, and proprioception. In some embodiments, insert 171 may be configured to provide performance characteristics desired for any of a variety of athletic activities, such as basketball, baseball, soccer, cross-training, football, running, walking, hiking, or other athletic activities. Further, in some embodiments, insert 171 may be configured for other types of activities, and accordingly, may be configured for casual wear, business wear, or wear in other settings.

In some embodiments, insert 171 can include first midsole 202. First midsole 202 may comprise outer surface 204 and inner surface 206. In addition, first midsole 202 includes raised perimeter portion 208 that extends from heel portion 24 to forefoot portion 20. In some cases, raised perimeter portion 208 may taper in height from heel portion 24 towards forefoot portion 20. In other cases, however, the height of perimeter portion 208 could vary in any other manner. In one embodiment, perimeter portion 208 may provide increased heel support for first midsole 202 at heel portion 24. For example, in some cases, perimeter portion 208 may function as a heel cup at heel portion 24.

In some embodiments, insert 171 can also include insole 220. In some cases, insole 220 may be disposed against inner surface 206 of midsole 202. In some cases, insole 220 can provide increased comfort for the foot. Also, in some cases, insole 220 can improve breathability and/or help to reduce moisture through the use of particular materials and/or structural features. In other cases, insert 171 may not include an insole.

In some embodiments, insert 171 can include first casing 240. The term "casing" as used throughout this detailed description and in the claims refers to any member configured to wrap around or otherwise cover some of a foot. In some cases, a casing could be a full length bootie that fully encloses a foot. In other cases, however, a casing could provide partial coverage of a foot. First casing 240 may be configured to wrap around a portion of a foot in order to secure midsole 202 to the foot. In some cases, first casing 240 comprises a substantially flexible material. In some cases, first casing 240 may be made of an elastic material to stretch and conform to the shape of the foot.

Generally, the size and shape of first casing 240 can be selected to achieve desired footwear characteristics including support and proprioception. For example, by selectively shaping first casing 240 to cover some parts of a foot, but not others, first casing 240 may be tuned to deliver sensory feedback to specific regions of the foot. This can be useful for enhancing the awareness of a user regarding different regions of the foot such as the midfoot and/or ankle. Specifically, in some situations, as a user moves his or her foot, the contact with first casing 240 can provide targeted proprioception at specific locations on the foot.

In some embodiments, first casing 240 includes midfoot portion 242 that extends around the midfoot region of a foot. In some embodiments, first casing 240 also includes heel portion 244 and ankle portion 246 for extending around the heel and ankle, respectively, of a foot. In some cases, first casing 240 may not extend into the forefoot region of a foot. For example, in one embodiment, forward most edge 248 of first casing 240 may be disposed rearwardly of forward most edge 210 of first midsole 202. In other embodiments, first casing 240 could have any other shape and could include portions associated with any portions of a foot, including the heel, midfoot, arch, ankle, instep, and forefoot, as well as any other portions. The particular configuration for first casing 240 discussed here may provide enhanced proprioception at the midfoot and ankle. Such sensory feedback can be useful in helping a user maintain awareness of the location of one or more regions of the foot, such as the ankle.

In some embodiments, casing 240 includes tongue portion 254. Tongue portion 254 extends up from midfoot portion 242 towards and into ankle portion 246. In some cases, tongue portion 254 may include slots 255 that provide some separation between tongue portion 254 and adjacent regions of ankle portion 246. This allows tongue portion 254 to move somewhat independently from ankle portion 246, thereby allowing a user to adjust the positioning of casing 240 by pulling on tongue portion 254.

In some embodiments, first casing 240 includes lower extending portion 250 that is configured to wrap around outer surface 204 of first midsole 202. In some cases, extending portion 250 could be permanently attached to first midsole 202. For example, in some cases, extending portion 250 may be attached to outer surface 204 using an adhesive. In other cases, other methods of attaching extending portion 250 to first midsole 202 could be used. In still other cases, extending portion 250 may not be permanently attached to first midsole 202.

As seen in FIG. 3, first casing 240 includes an opening 260 at ankle portion 246 that is configured to allow entry of a foot into first casing 240. In addition, as seen in FIG. 3, first casing 240 includes an opening 262 at lower portion 268. Therefore, as a foot is inserted into first casing 240, opening 262 allows the foot to come into direct contact with insole 220 and/or a portion of first midsole 202.

In some embodiments, first casing 240 can also include fastening member 280. In some cases, fastening member 280 could be a strap. In other cases, however, fastening member 280 could be any other kind of fastening mechanism known in the art for fastening a component of an article of footwear. For example, in another embodiment, fastening member 280 could comprise a lace.

In one embodiment, fastening member 280 comprises an ankle strap that extends around ankle portion 246. In some cases, first end portion 282 of fastening member 280 is permanently attached at lateral side 28 of first casing 240. Second end portion 284 of fastening member 280 may include first fastening portion 286 that engages second fastening portion 288 on medial side 28 of first casing 240. In some cases, first fastening portion 286 and second fastening portion 288 could be corresponding sides of a hook and loop fastener system, such as Velcro©. In other cases, however, first fastening portion 286 and second fastening portion 288 could comprise corresponding portions of any other kind of fasteners including, but not limited to: buttons, snaps, zippers, interlocking tabs, cinching mechanisms, as well as any other means of fastening a strap.

FIG. 4 illustrates insert 171 in an assembled configuration. FIG. 4 further shows fastening member 280 in a fastened position. In the fastening position, fastening member 280 may be disposed over tongue portion 254 of first casing 240, as shown in FIG. 4.

FIG. 5 illustrates a perspective view of an embodiment of first insert 171 placed within first outer assembly 122 to form an article of footwear 1000. For purposes of illustration, the portions of first insert 171 that are disposed within first outer assembly 122 and normally hidden from view are shown in phantom in FIG. 5. As seen in FIG. 5, first midsole 202 and first insole 220 are disposed within outer sole portion 134 and positioned to provide support to the lower surface of a foot. Moreover, in some cases, perimeter portion 208 of first midsole 202 provides enhanced heel support. In some cases, perimeter portion 208 may extend into the interior cavity of upper portion 132. In addition, as shown in FIG. 5, opening 260 may be aligned with opening 138 of first outer assembly 122 when insert 171 is inserted within outer assembly 122.

First casing 240 may be positioned to receive the midfoot portion of a foot. In some cases, ankle portion 246 may extend through opening 138 of upper portion 132, as shown in FIG. 5. Also, in some cases, tongue portion 254 is aligned beneath gap 156 of fastening region 150, including both first fastening edge 152 and second fastening edge 154. By aligning tongue portion 254 with fastening region 150, tongue portion 254 can help protect a foot from experiencing undesirable pressure from fastening system 140.

To fully secure first insert 171 to a foot, fastening member 280 may be fastened around ankle portion 246. This helps to tighten opening 260 around a foot. With first insert 171 fully secured to a foot, a user may then use fastening system 140 to tighten opening 138 of outer assembly 122 around the foot. This helps to secure outer assembly 122 to the foot.

Heatable and Coolable Inserts

Traditionally therapeutic treatments have been stationary, localized activities. For example, an athlete or other person being treated will typically sit or lie down in a training room or physical therapy office and receive the treatment. While receiving therapeutic heat (for example, by hot pads or hot whirlpool) or cold (for example, by ice packs or ice baths), an athlete will commonly be required to remain in one place. In some cases, ice or heat may be applied to certain parts of the body in a manner that may allow the athlete to move around in a restricted manner. For example, ice bags may be strapped to an athlete's knees, which may allow the athlete to walk around gingerly. Nevertheless, hot and cold foot treatments are typically administered to an athlete without their shoes on, because the transfer of heat or cold to the feet is more effective when directly applied to the feet, without having to conduct through the footwear.

It is desirable to limit the amount of "down time" during which a person needs to remain stationary to receive foot treatment. In the case of athletes, in many cases, the athletes have busy schedules surrounding sporting events and practices. For example, a student athlete may have class that is scheduled at a time that falls directly before, after, or even overlapping with daily practices or games. In addition, student athletes, as well as professionals, often have rigorous travel schedules, leaving after late evening games to make transfers to the next event. Performers, such as dancers, may also have similar schedules following physically demanding performances. Further, student athletes and professional athletes sometimes have other commitments following sporting events that may be difficult to keep while still maintaining a desired treatment regimen. For example, student and professional athletes often are required to attend post-game press conferences. These types of post-game commitments often interfere with the athlete's ability to receive desired treatment. Non-professional athlete adults also often exercise with a limited amount of time available to dedicate to the activity. For example, business professionals often prefer to workout or participate in sporting activities in the morning before work or during lunchtime at or near work. In addition, adults often maintain schedules that are crowded with other commitments and responsibilities, such as activities of their children. There may be minimal time in the day for adults to get in the workout they desire, or to play in adult sports league games, let alone obtain suitable therapeutic treatment before and/or after such activities.

In view of the considerations noted above related to tight scheduling surrounding athletic activities, it would be desirable to provide athletes with the ability to receive treatment, particularly for the feet, while still remaining relatively ambulatory. Accordingly, the present disclosure is directed to embodiments of interchangeable footwear inserts, where one of the inserts may be heatable and/or coolable. For example, in some exemplary embodiments, a system may include a first pair of performance inserts, which may be configured to provide conventional performance characteristics, such as cushioning, responsiveness, comfort, and other properties desired by the wearer (for example for a particular type of athletic activity); and a second pair of therapeutic inserts, which may be configured to be heated or cooled and then inserted into the footwear as replacements for the performance inserts. Such therapeutic, heatable and/or coolable inserts may include a high heat capacity material that may be configured to store heat energy applied to the inserts and/or retain temperature decreases in the inserts.

An exemplary system may include a pair of performance inserts and pair of therapeutic inserts, where the therapeutic inserts each have a form that is substantially similar to that of the corresponding performance insert, in order to allow a wearer to wear the footwear, at least casually, with the therapeutic insert installed. This may enable the wearer to remain ambulatory during therapeutic (heat/cold) treatment. With such a system, an athlete may use heated inserts prior to a game to warm up their feet/ankles, which may help to loosen up injured or arthritic foot/ankle joints. This may be carried out without having to sit in a training room for 30 or more minutes before the game (note also that, outside of scholastic and professional sports, there may not even be a training room available to provide treatment). Therefore, a busy adult or a traveling athlete may wear the footwear with heated inserts while traveling en route to the game. Such self-administered treatment may even be performed while driving oneself, at least when using heated inserts. Similarly, an athlete may use cooled inserts immediately following a game, for example, in order to return to their desk at work after a lunch time game, or to attend a post-game press conference during a time when many players are receiving treatment.

Figure 6:
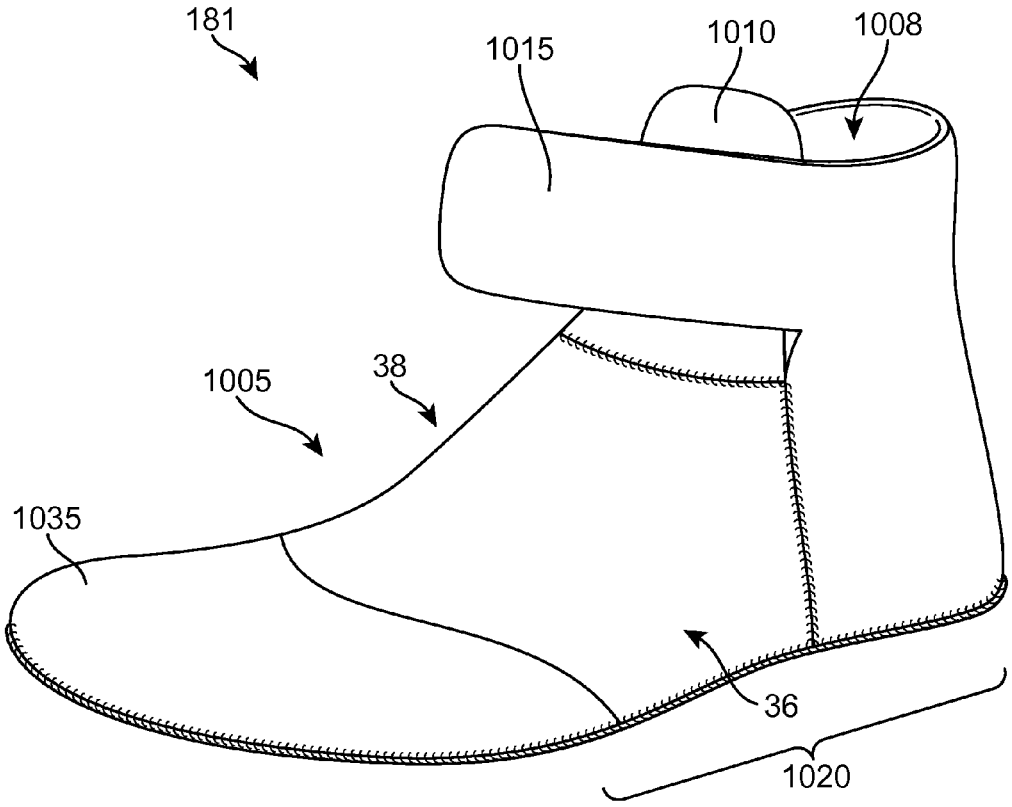
FIG. 6 is a perspective view of an embodiment of an insert for an article of footwear.
Figure 7:
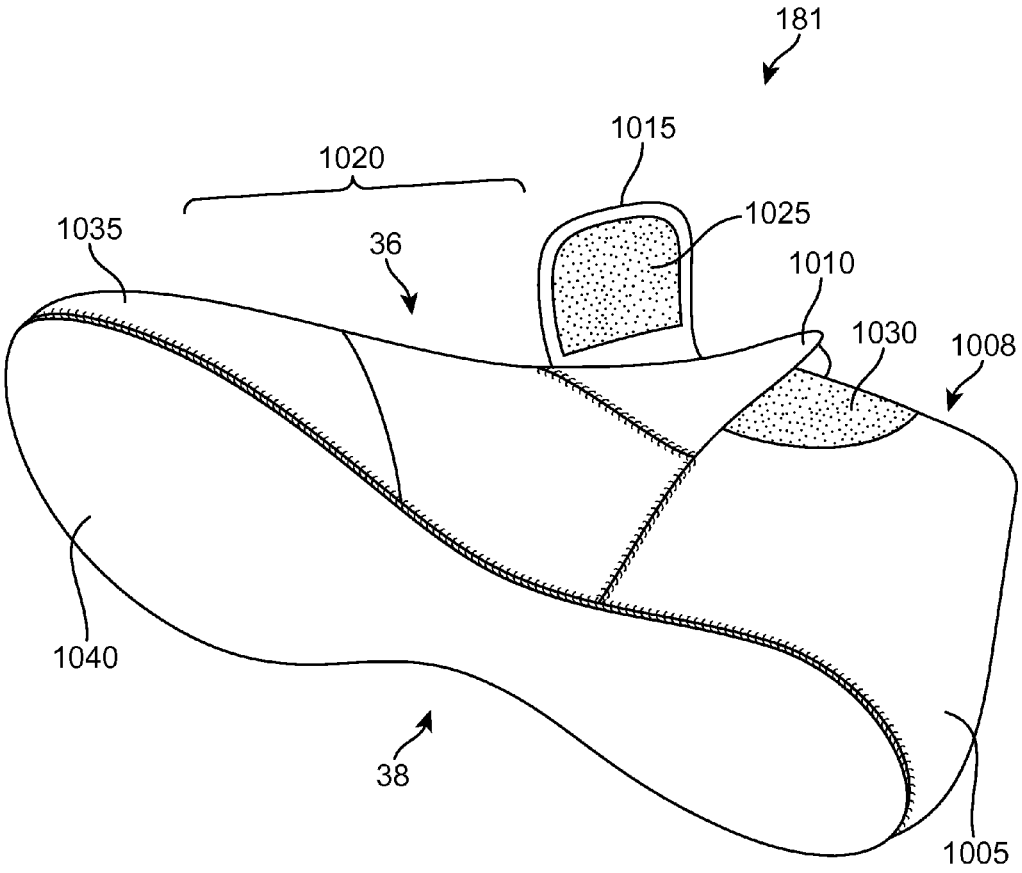
FIG. 7 is a bottom perspective view of an embodiment of an insert for an article footwear.

FIGS. 6 and 7 illustrate views of insert 181. In some embodiments, insert 181 may be heatable and/or coolable. In a heated or cooled state, insert 181 may be used for therapeutic purposes, for example, as described above regarding athletics. In addition, in some embodiments, insert 181 may be used for non-therapeutic purposes, such as temperature control. For example, in some cases a heated insert 181 may be used to keep the feet warm in cold weather conditions. In such cases, insert 181 may be used with athletic shoes for cold weather sports such as hockey, skiing, late-season American football, and activities such as running or cycling that may be performed in cold weather at times. In some such cases, insert 181 may be used with footwear that is not necessarily configured for athletics, such as casual footwear, work-type footwear such as work boots, and cold weather footwear, such as hiking boots, winter boots, and other such footwear.

As shown in FIG. 6, insert 181 may be configured to receive a foot of a wearer. Accordingly, insert may include a casing 1005. Casing 1005 may be configured to at least partially enclose a foot of a wearer. In some embodiments, casing 1005 may partially enclose a foot of a wearer. Such embodiments may have an open toe configuration, where the toes of the wearer are exposed. Such configurations may be suitable for situations where the therapeutic treatment is targeted in other portions of the foot, such as the ankle. As shown in FIG. 6, in other embodiments, casing 1005 may be configured to completely encase the foot of a wearer. In some embodiments, insert 181 may be configured to cover a different surface area of the foot than insert 171 with which insert 181 may be interchangeable.

Casing 1005 may define an opening 1008 configured to receive the foot of a wearer. In addition, in some embodiments, casing 1005 may also define a tongue portion 1010 and a fastening member 1015, the fastening member 1015 being configured to wrap around the tongue portion 1010. For example, as shown in FIG. 6, fastening member 1015 may be the same or substantially the same as fastening member 280 of insert 171 discussed above. In other embodiments, fastening member 1015 may be substantially different than fastening member 280.

As shown in FIG. 6, in some embodiments, fastening member 1015 may include a strap. Such a strap may be configured to wrap around the foot in any suitable direction. For example, as shown in FIG. 6, fastening member 1015 may be configured to wrap around insert 181 toward medial side 38 of insert 181. In other embodiments, however, fastening member 1015 may be configured to wrap around insert 181 toward lateral side 36, as shown in FIG. 7.

The free end of fastening member 1015 may be configured to be secured to insert 181 with a suitable attachment mechanism. For example, in some embodiments, fastening member 1015 may be closed with hook and loop fasteners. Accordingly, as shown in FIG. 7, casing 1005 may include hook and loop fastener components 1025 and 1030.

As also shown in FIG. 7, casing 1005 may be formed of a plurality of panels 1020. Panels 1020 may be joined at seams formed in any suitable way, such as with stitching, welding, or other joining methods. Various exemplary seam configurations are discussed in greater detail below.

Panels 1020 may include upper panels 1035 that may form an upper portion of casing 1005, which may correspond with an upper of an article of footwear, as shown in FIG. 7. In addition, panels 1020 may include a sole panel 1040. The panel configuration shown in the accompanying figures is exemplary only, and the location of seams, and arrangement of panels 1020 may vary according to any number of design considerations, such as cost, fit, ease of manufacture, the type of footwear for which it is designed (for example, high top or low top), and other factors.

Figure 8:
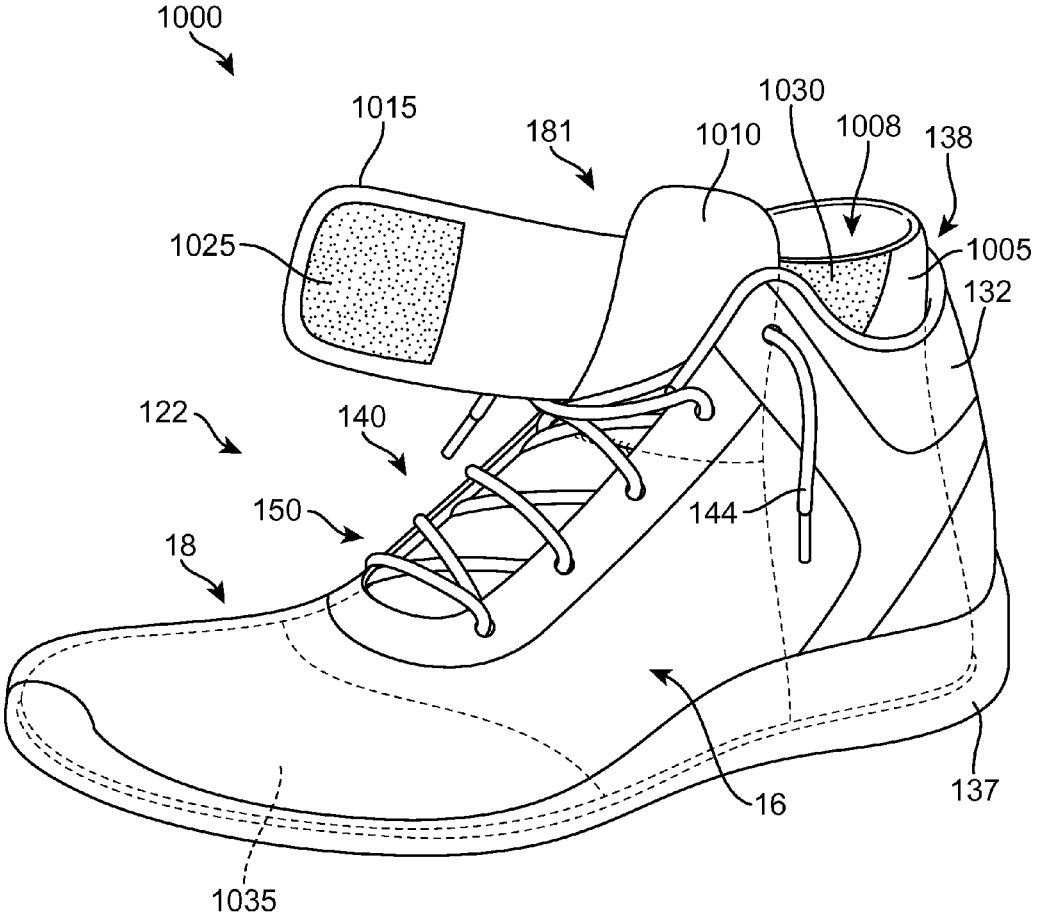
FIG. 8 is a perspective view of the insert shown in FIG. 7 inserted into an outer assembly with the fastening system of the outer assembly and a fastening member of the insert unfastened.

FIG. 8 shows insert 181 inserted in outer assembly 122. It is noted that upper portion 132 of outer assembly 122 is shown with minimal detail in FIG. 8 in order to facilitate illustration of hidden features of insert 181, which are shown in phantom.

Outer assembly 122 may be configured to receive the foot of a wearer when the foot is received within insert 181. It should be noted that insert 181 may be configured to be put on the foot of a wearer before inserting into outer assembly 122. Also, insert 181 may be configured to be inserted into outer assembly 122 to form an assembled article of footwear 1000. Once article of footwear 1000 has been assembled in this manner, the wearer may put the assembled article of footwear 1000 onto their foot by inserting the foot into opening 1008, which may be substantially aligned with opening 138 of outer assembly 122.

In order to allow the wearer to insert their foot into article of footwear 1000 with insert 181 installed, fastening member 1015 may be closed after insertion into outer assembly 122. For example, article of footwear 1000 may be configured such that insert 181 may be inserted into outer assembly 122 and fastening member 1015 may be left open, as shown in FIG. 8. Once the wearer's foot is inserted, fastening member 1015 may be closed while upper portion 132 of outer assembly 122 is still loosely fitted about insert 181 and the wearer's foot, before laces 144 are tied. This may be facilitated by a height differential between insert 181 and outer assembly 122. For example, in some embodiments, some or all of fastening member 1015 may extend above the top edge of outer assembly 122, which may enable closure of fastening member 1015 with little, if any impedance from outer assembly 122. Once fastening member 1015 is closed, laces 144 may be tightened and tied to complete the process of putting article of footwear 1000 onto the foot.

Figure 9:
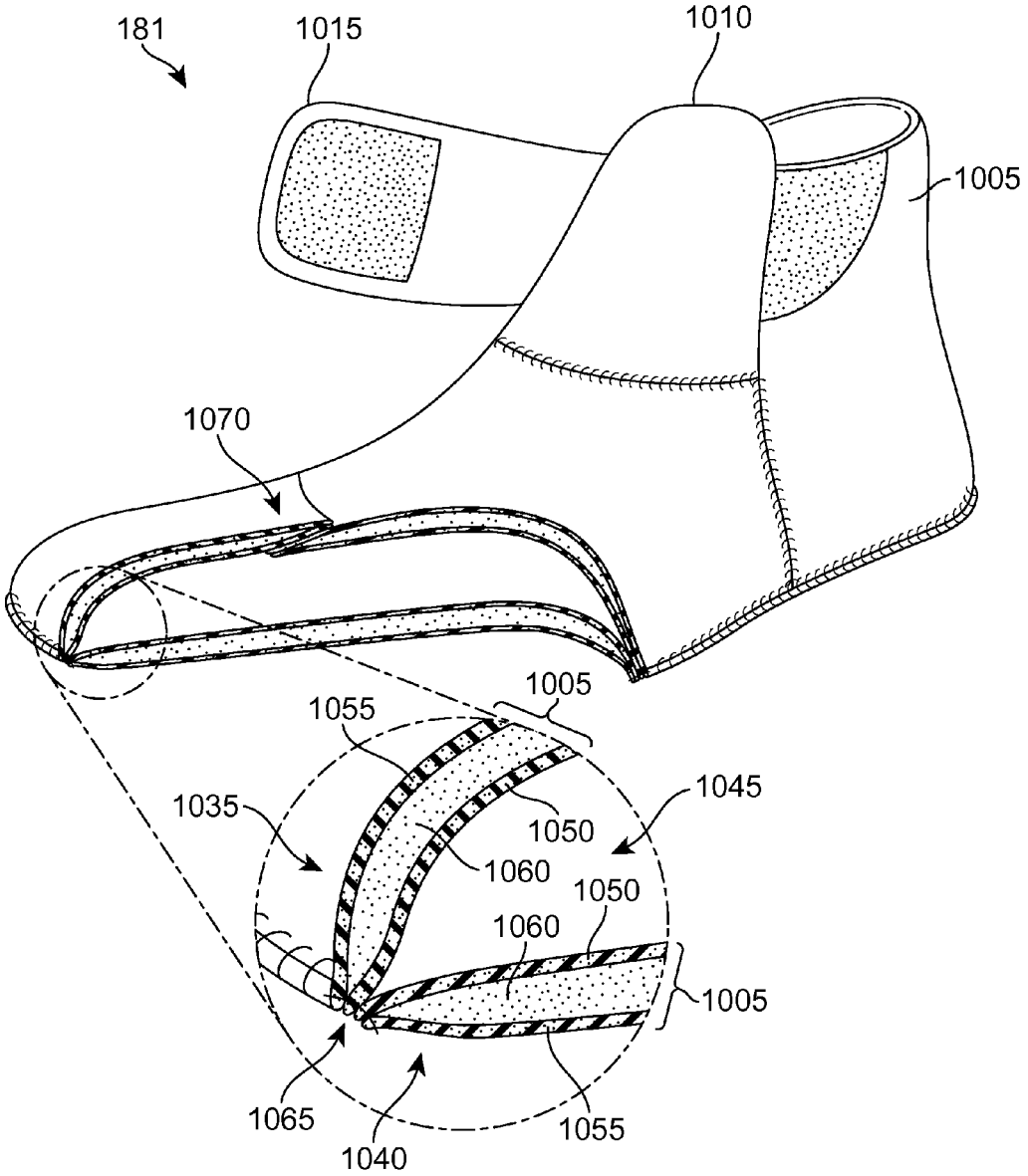
FIG. 9 is a perspective, partial cut-away view of an embodiment of an insert.
Figure 10:
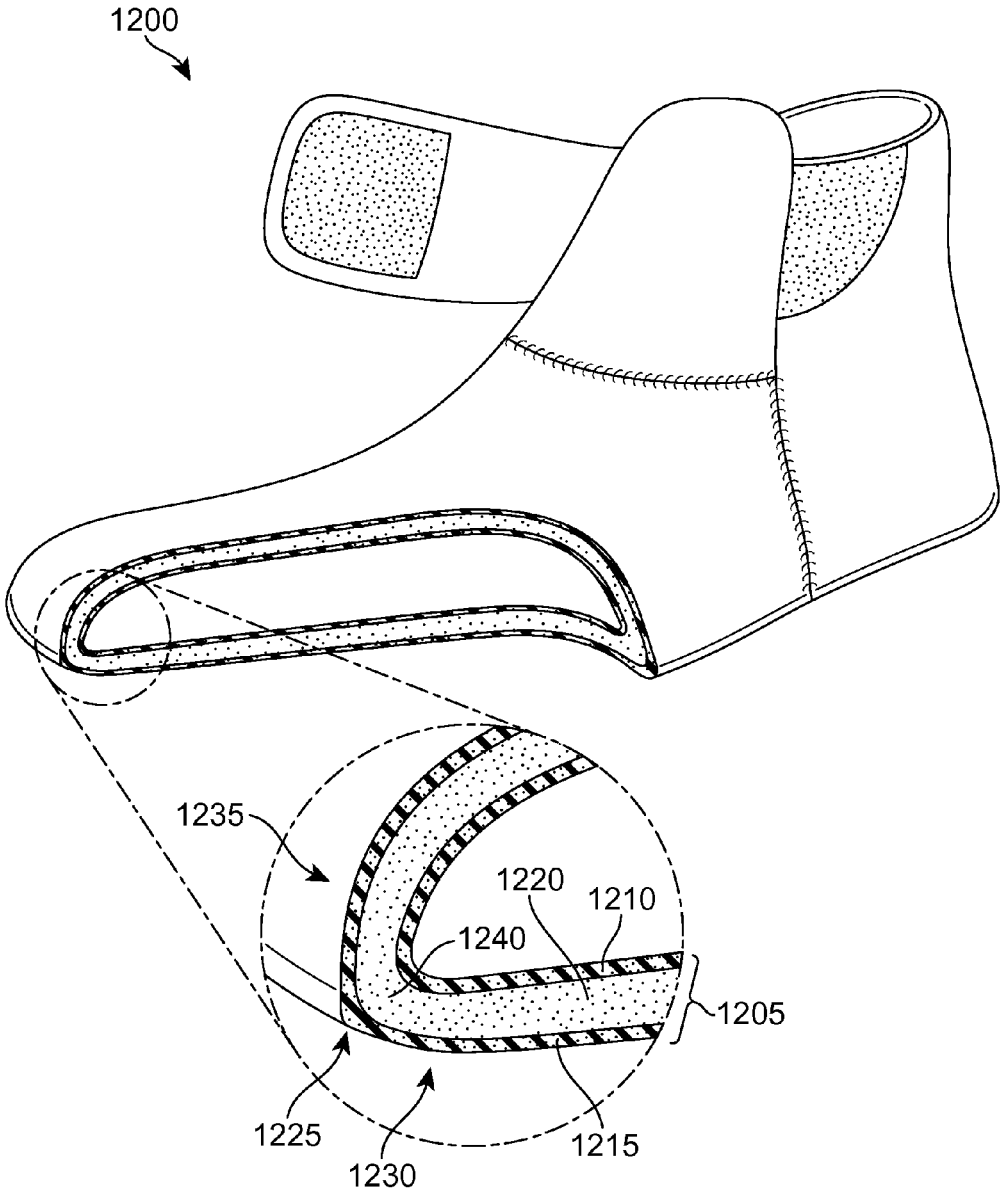
FIG. 10 is a perspective, partial cut-away view of another embodiment of an insert.
Figure 11:
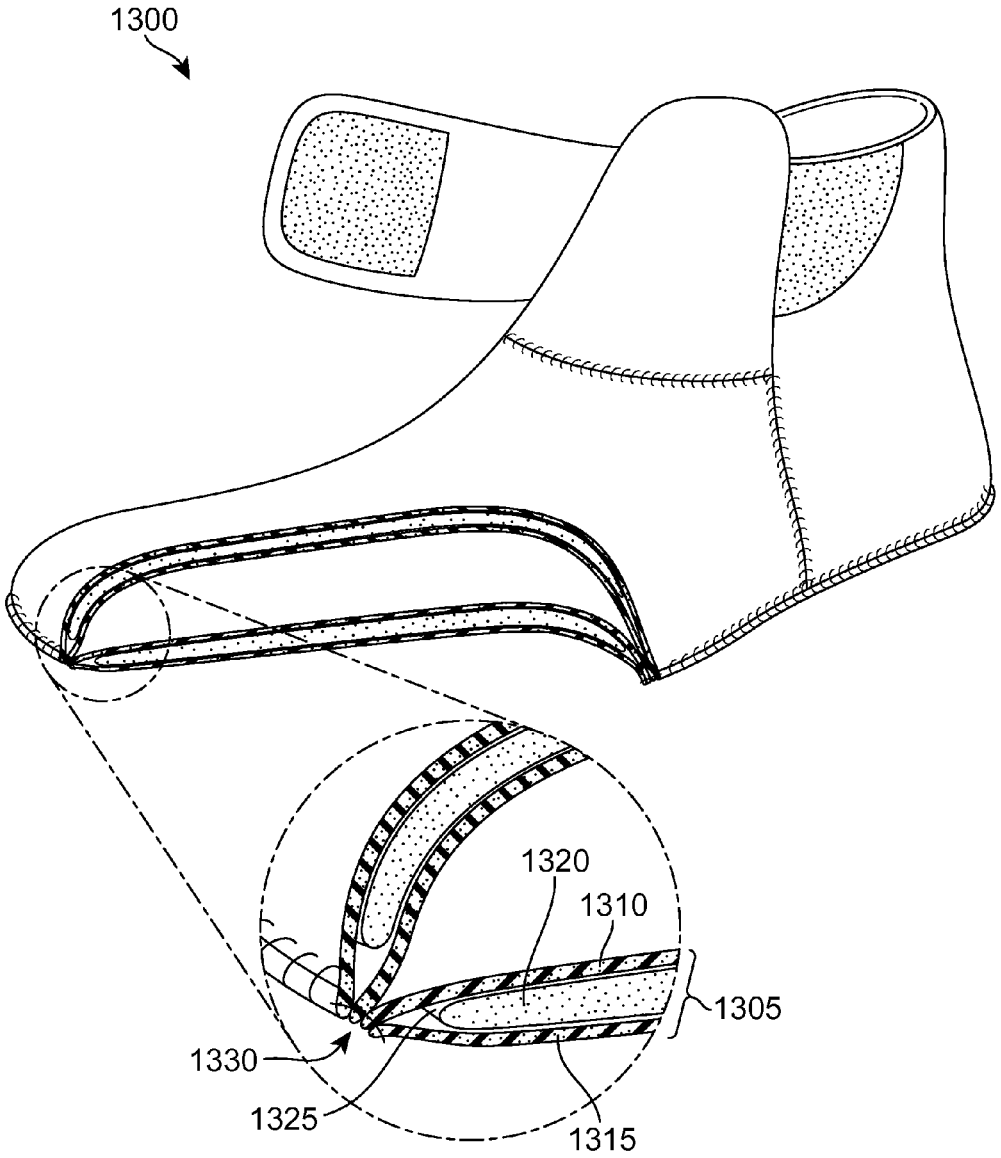
FIG. 11 is a perspective, partial cut-away view of another embodiment of an insert.

FIGS. 9 through 11 show several insert embodiments illustrating exemplary features of a heatable and/or coolable footwear insert. FIG. 9 is a cutaway view, showing a cross-section of casing 1005 of insert 181. As shown in FIG. 9, casing 1005 may define an inner cavity configured to receive the foot of a wearer. Casing 1005 may be formed of a casing material and a high heat capacity material. For example, as shown in FIG. 9, casing 1005 may include an inner casing layer 1050 and an outer casing layer 1055, wherein inner casing layer 1050 and outer casing layer 1055 may define a cavity between the two layers. Casing 1005 may also include a high heat capacity material 1060 contained in the cavity between inner casing layer 1050 and outer casing layer 1055.

In some embodiments, insert 181 may consist essentially of casing 1005. While some heating/cooling footwear therapeutic booties have been developed, such booties have included additional components configured to provide heat to the insert. For example, some systems have included a bootie with electrical heating elements and, in some cases, additional electronic equipment. Such systems have bulky components that preclude insertion of the bootie into an article of footwear and/or require the bootie to be plugged into a power source. Accordingly, such systems are not ambulatory and, therefore, have limited applicability as compared to the ambulatory embodiments described in the present disclosure. Such systems may also be complicated and/or expensive to produce. Thus, in some embodiments, insert 181 may consist essentially of casing 1005, which may consist essentially of casing layers 1050 and 1055 and high heat capacity material 1060.

In different embodiments, the materials utilized in constructing the casing may vary. For example, the casing layers may be constructed of any suitable materials. In some embodiments, the inner casing layer may be formed of a different material than the outer casing layer. In other embodiments, the inner casing layer may be formed of the same material as the outer casing layer. The casing layer materials may be selected based on a number of different considerations, including elasticity, durability, comfort, puncture resistance, flexibility, weight, thermal conductivity, properties at high and/or low temperatures, and other factors. In addition, in some embodiments, desirable casing layer characteristics may include resistance to diffusion of gases into the high heat capacity cavity. Further, in some embodiments, a consideration for sole panel material choice may include the forces applied to the sole panel when bearing the weight of the wearer.

In some embodiments, exemplary casing layer materials may include various kinds of textiles. Textiles are generally manufactured from fibers, filaments, or yarns that are, for example, either (a) produced directly from webs of fibers by bonding, fusing, or interlocking to construct non-woven fabrics and felts or (b) formed through a mechanical manipulation of yarn to produce a woven fabric. The textiles may incorporate fibers that are arranged to impart one-directional stretch or multi-directional stretch, and the textiles may include coatings that form a breathable and water-resistant barrier, for example. Examples of textile materials that could be used include, but are not limited to: animal textiles, such as wools and silks, plant textiles, such as cotton, flax, and lyocell, synthetic textiles such as polyester, aramid, acrylic, nylon, spandex, olefin fiber, ingeo, lurex and carbon fibers. In other embodiments, materials used for making a casing could include non-woven fabrics, polymer layers, natural leathers, synthetic leathers as well as any other materials. In one embodiment, a casing can be at least partially made of neoprene. Moreover, different inserts could utilize different materials for a casing to provide variations in elasticity, cushioning and proprioception provided by a casing.

The high heat capacity material may have a specific heat capacity suitable for storing and transferring heat and/or cold. Some materials may be more suited for storage and transfer of heat than storage and transfer of cold. Other materials may be more suited for storage and transfer of cold. Some materials may be suited equally well for storage and transfer of heat and cold. Accordingly, materials may be selected according to the anticipated use of the insert. For example, inserts developed for hiking in cold weather may implement a material that is better suited for heat storage and transfer. In contrast, an insert developed for a basketball player may utilize a material that is better suited for storage and transfer of cold, with cold treatments of sore or injured ankles (a common basketball injury) particularly in mind.

The high heat capacity material may remain conformable to the contours of the wearer's foot over a broad temperature range. In some embodiments, the high heat capacity material may include an aggregate material. For example, in some embodiments, the high heat capacity material may include grains, such as wheat, buckwheat, and/or flax seed. In some embodiments, the high heat capacity material may include synthetic aggregate materials. Inserts formed with aggregate materials may be conformable in the manner of a bean-bag, for example.

In some embodiments, the high heat capacity material may be water based. Accordingly, the high heat capacity material may have approximately the same specific heat capacity as water. That is, the high heat capacity material may have a specific heat capacity that is approximately 4181.3 J/(kg*deg K) or 4.1813 J/(g*deg C.). In addition, the material may include additives that alter the properties of water. For example, additives may be added that alter the heat capacity of the material, for example, by increasing the specific heat capacity. Therefore, in some embodiments, the high heat capacity material may have a specific heat capacity that is higher than 4.1813 J/(g*deg C.). In other embodiments, the high heat capacity material may have a specific heat capacity that is slightly lower than 4.1813 J/(g*deg C.), for example, due to the inclusion of other additives.

The high heat capacity material may include thickeners or other agents. For example, thickeners may be added to increase the viscosity of the material. Further, agents may be added to form a gel or gel-like material. A gel or gel-like material may be beneficial for use in the disclosed inserts, as the gel may be well-suited to conform around the contours of a wearer's foot. The gel may also maintain a set that enables the gel to remain distributed relatively evenly within the cavity between layers of the casing. This may prevent the high heat capacity material from collecting at bottom portions of the insert due to gravity and/or the forces exerted by walking.

In some embodiments, the material may include additives that alter the freezing and/or boiling points of water. For example, in some cases one or more additives may be included to both lower the freezing point of the material, and raise the boiling point of the material. For example, for a water-based material, the additives may increase the boiling point and/or lower the freezing point beyond the boiling point and freezing point of water. This may enable the material to maintain its consistency (for example, as a non-solid material, such as a conformable gel or a flowable fluid) over a wide range of temperatures. In addition to maintaining conformability of the high heat capacity material, altered freezing and/or boiling points may provide greater flexibility with regard to the range of temperatures at which the insert may be used and/or may increase the amount of time that the insert can provide effective thermal treatment. For example, by enabling the insert to be cooled below the freezing temperature of water, a colder treatment (for example, colder than ice, which is commonly used for cold therapy) may be administered. In addition, a material that can be cooled to a lower temperature and still maintain its conformable consistency may be used with a wider variety of casing materials. For example, a casing material that has lower thermal conductive properties may be desirable for other characteristics, such as moisture wicking or comfort. An insert with such a casing material may be used for effective cold therapy if the high heat capacity material contained within the less conductive casing material can be cooled to a lower temperature.

Those having ordinary skill in the art will readily recognize suitable additives for high heat capacity materials. Further, suitable high heat capacity gel materials are known in the field of reusable/cold packs.

In some embodiments, the high heat capacity material may be configured to remain in a non-solid phase in a working temperature range from approximately 31 degrees Fahrenheit to approximately 140 degrees Fahrenheit. For example, the high heat capacity material may have the consistency of a gel in this working temperature range. Temperatures of approximately 31 degrees Fahrenheit may be readily achievable with conventional refrigerators/freezers, or ice-filled coolers. Thus, 31 degrees Fahrenheit corresponds with practically achievable temperatures, and also corresponds with typical ice therapy treatments. Temperatures of approximately 140 degrees Fahrenheit correspond with the upper range of conventional heat therapy treatments.

In some embodiments, the high heat capacity material may be configured to remain in a non-solid phase in a working temperature range from approximately 31 degrees Fahrenheit to approximately 99 degrees Fahrenheit. Temperatures of approximately 99 degrees Fahrenheit correspond with temperatures that a cooled insert may be heated to during wear by a user. That is, the insert may be raised to, or slightly above, human core body temperature (98.6 degrees Fahrenheit). In some embodiments, the high heat capacity material may be configured to remain in a non-solid phase up to temperatures slightly higher than human body temperature, as temperatures inside the shoe of a wearer may be slightly elevated above body temperature. Such a material would be suited for at least cold therapy. In some embodiments, the high heat capacity material may be configured to remain in a non-solid phase in a working temperature range from approximately 70 degrees Fahrenheit (approximately room temperature) to approximately 140 degrees Fahrenheit. Such a material would be suited for at least heat therapy.

The amount and location of the high heat capacity material may be tailored to achieve various thermal treatment capabilities. For example, a higher volume of high heat capacity material will enable transfer of a greater amount of thermal heat transfer to or from the insert for a given use. That is, a greater amount of energy may be transferred in the process of cooling a heated insert back down to body temperature, and a greater amount of energy may be transferred in the process of warming a cooled insert back to body temperature if there is more high heat capacity material to store the energy.

In addition, the location at which the high heat capacity material is disposed in the insert may be selected to enable targeted heating/cooling of one or more portions of the foot. Selective placement of high heat capacity material may be implemented by use of multiple casing panels. In some insert embodiments having a plurality of panels, more than one of the plurality of panels may include the high heat capacity material. In some embodiments, high heat capacity material may be contained within one casing panel of an insert but not in other panels of the same insert.

Generally, the size and shape of an insert can be selected to achieve desired footwear characteristics including support and targeted proprioception. In addition, the panels of an insert may be configured for targeted heating, such as around the ankle, heel, Achilles tendon, sole, midfoot region, and/or toe region. For example, by selectively locating high heat capacity material in panels covering some parts of a foot, but not others, the insert may be configured to administer thermal therapy in selected regions of the foot. This can be implemented, for example, for cold therapy, to avoid discomfort to portions of the foot that are not injured. For example, cold therapy is commonly administered to treat sprained ankles, however, other portions of the foot that do not warrant treatment in such instances, such as toes, may be sensitive to the cold, and thus, there may be a desire to avoid subjecting such foot portions to the cold treatment. Accordingly, in some, embodiments, the insert may include high heat capacity material only in areas proximate the ankle region, and not proximate the toe region.

In some embodiments, the height of the heatable/coolable insert may correspond with a mid-cut or high-top article of footwear. In some cases, the insert may have a mid-cut or high-top height, even if the outer assembly has a low cut height. This may facilitate thermal transfer to or from upper portions of the foot, such as the ankle and/or Achilles tendon area.

Panels of casing 1005 may be joined in any suitable way. As shown in FIG. 9, upper panels 1035 may be joined to sole panel 1040 by a seam 1065. In some embodiments, seam 1065 may be stitched, as shown in FIG. 9. In some embodiments, seam 1065 and/or other seams of casing 1005 may form seals that contain the high heat capacity material within casing 1005. In some embodiments, additional materials may be used to form seams, such as adhesives, sealing materials, and other suitable materials.

In some cases, seams may be formed by stitching, or otherwise joining, a plurality of panel layers. For example, as shown in FIG. 9, seam 1065 is formed by stitching through inner casing layer 1050 and outer casing layer 1055 of upper panel 1035 and inner casing layer 1050 and outer casing layer 1055 of sole panel 1040. In some cases, seams may be formed in an overlapping manner, for example, at abutting panel junctions. For instance, seam 1070 illustrates overlapping panels. Such seams may be formed with stitching, adhesive, welding, or other joining methods.

FIG. 10 shows another exemplary insert 1200. Insert 1200 may include a casing 1205, including an inner casing layer 1210, an outer casing layer 1215, and a high heat capacity material 1220 contained between inner casing layer 1210 and outer casing layer 1215. As shown in FIG. 10, inner casing layer 1210 and outer casing layer 1215 may be configured in a sock-within-a-sock (concentric) configuration. That is, there may little or no fixed connection between inner casing layer 1210 and outer casing layer 1215. This configuration may have the advantage of a more complete encapsulation of the foot with high heat capacity material. For example, as shown in FIG. 10, a toe area of high heat capacity material 1240 may be provided, while seams such as seam 1065 in FIG. 9 may have a gap, albeit small, between the high heat capacity materials in the sole panel and the upper panels. Complete encapsulation may be beneficial, for example, in winter boots, where whole foot thermal transfer is desired, particularly in the toe region.

In some embodiments, casing seams, such as perimeter seam 1225, may be formed using stitch-free methods, such as welding, or adhesives. Such seams may form seals that contain the high heat capacity material within casing 1205, as described above.

FIG. 11 illustrates another exemplary casing configuration. As shown in FIG. 11, an insert 1300 may include a casing 1305, including an inner casing layer 1310, an outer casing layer 1315, and a high heat capacity material 1320 contained within inner casing layer 1310 and outer casing layer 1315. As further shown in FIG. 11, casing 1305 may include a bladder layer 1325 disposed within the cavity between inner casing layer 1310 and outer casing layer 1315. Bladder layer 1325 may provide a barrier to contain the high heat capacity material within the cavity. Accordingly, seams such as seam 1330 may be provided without a fluid-tight seal. For example, as shown in FIG. 11, seam 1330 may be simply closed with stitching.

Bladder layer 1325 may be formed of materials suitable for containing the high heat capacity material. Therefore, different bladder materials may be used depending on the type of high heat capacity material used. The bladder material may be configured to prevent leakage of the high heat capacity material, resist puncture and/or tearing, and, at least in the case of high heat capacity materials located in sole panels, the bladder layer may be configured to resist pressure created by the weight of a wearer when being supported by the sole panel. Further, the bladder layer may be configured such that the combination of the bladder and the high heat capacity material in the sole panel provides desired cushioning for the wearer, at least suitable for casual wear, and possibly for more demanding activities, such as hiking or cold weather sports. In addition, suitable bladder materials may be resistant to diffusion of gases and/or external moisture into the bladder. Possible bladder materials may include ethylene vinyl alcohol, polyurethane, and/or other such materials. Those having ordinary skill in the art will recognize materials that are suitable for use as bladder materials according to the considerations discussed above.

Figure 12:
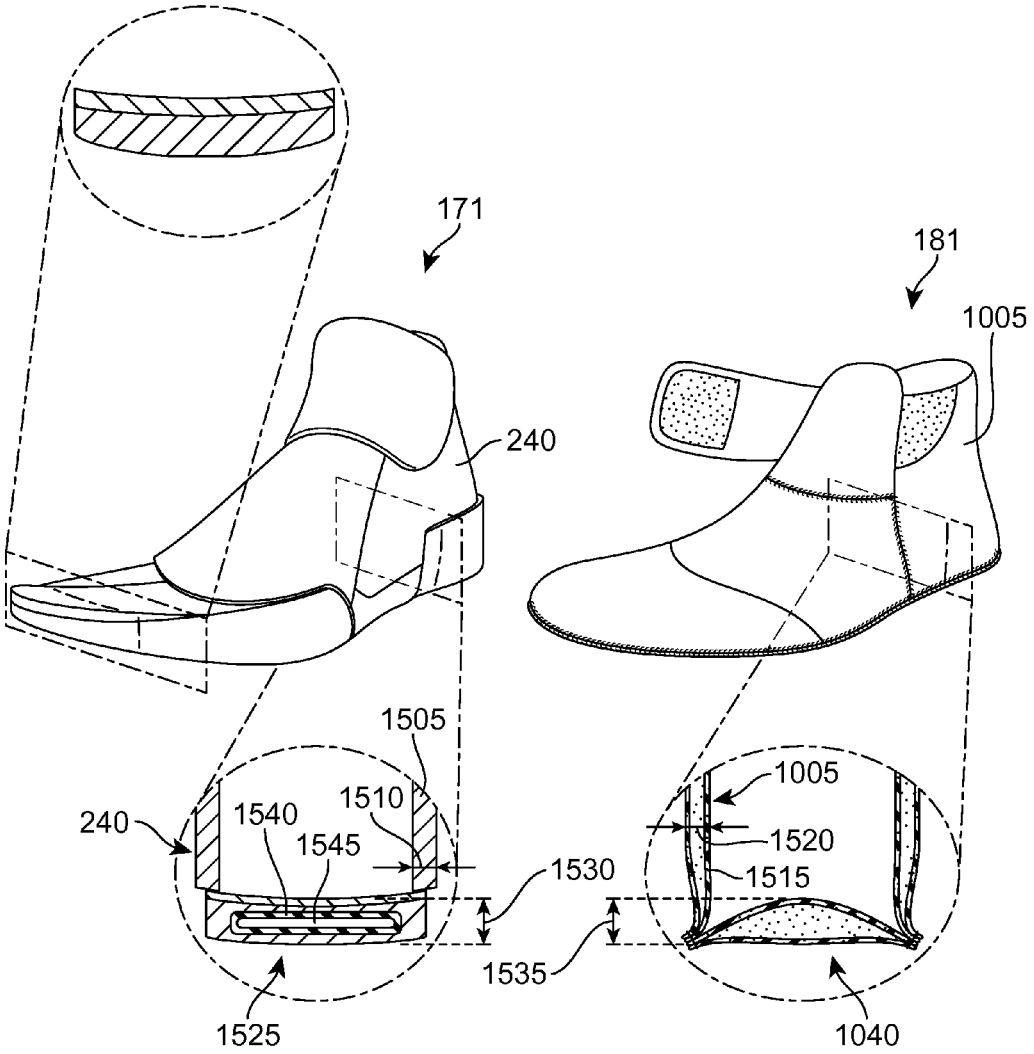
FIG. 12 shows perspective, partial cross-sectional views of two interchangeable inserts.

FIG. 12 illustrates insert 171 and insert 181 with partial cross-sectional views illustrating various differences and similarities between the two types of inserts. In some cases, the different inserts in a system may be configured with different material and/or structural features in order to tune the insert to provide predetermined footwear characteristics. However, in some embodiments, the inserts may be sized to provide similar fit. For example, in some embodiments, the wall thicknesses of insert 171 and insert 181 may be substantially similar. As shown in FIG. 12, casing 240 of insert 171 may have an upper wall 1505, which may have a first thickness 1510. Casing 181 may have an upper wall 1515, which may have a second thickness 1520. In some embodiments, first thickness 1510 may be substantially similar to second thickness 1520. In addition, insert 171 may include a sole panel 1525, which may have a first sole thickness 1530, and sole panel 1040 of insert 181 may have a second sole thickness 1535.

In some embodiments, the thickness of at least some corresponding areas of the inserts may be substantially similar. For example, in some embodiments, insert 171 may have a wall thickness in each area of casing 240, insert 181 may have a wall thickness in each area of casing 1005, and in each area of insert 181, the wall thickness of casing 1005 may be substantially the same as the wall thickness in a corresponding area of insert 171.

Since both insert 171 and second insert 181 are configured to fit in an outer assembly of an article of footwear, between the outer assembly and the wearer's foot, the substantially similar thicknesses of upper wall 1505 and 1515 and/or the substantially similar thicknesses of sole panels 1325 and 1040 may provide a consistent fit of the footwear when wearing either of the inserts. That is, the article of footwear may fit similarly with either insert installed.

The consistency of fit between two inserts may be related to volume of the casings. For example, in some embodiments, casing 240 of insert 171 may define a first volume configured to substantially fill a void between the outer assembly and the foot of the wearer, casing 1005 of insert 181 may have a second volume configured to substantially fill a void between the outer assembly and the foot of the wearer, and the first volume and the second volume may be approximately equal. This may provide similar fit for the article of footwear with a performance insert and the heatable/coolable insert.

In other embodiments, the wall thicknesses (and/or volumes) of the two inserts may be different. For example, it may be desirable to provide more or less space within the article of footwear when using a heated or cooled insert. For example, it may be desired to use a tighter insert for treatment of acute injuries to prevent and/or reduce swelling, for example, while administering cold therapy. In other cases, such as treatment of an athlete who is recovering from an injury, it may be desirable to provide extra space within the article of footwear when wearing the heatable/coolable insert, to provide relief/comfort to a wearer with a swollen foot, particularly since injured feet can swell during the course of athletic activity. In other cases, it may be desirable to provide extra space in footwear when using heatable inserts to keep the feet warm in cold weather by promoting blood circulation in the foot.

In some embodiments, one or more of the inserts could incorporate various kinds of bladders and/or fluid chambers, for example, for cushioning. For example, as shown in FIG. 12, sole panel 1325 of insert 171 may include a fluid bladder 1540 defining a chamber 1545 for containing a fluid. Fluid bladder 1540 can increase cushioning and enhance comfort for a user. In some embodiments, sole panel 1040 may be configured to provide cushioning and comfort, as well, for example to at least partially replace the cushioning provided by fluid bladder 1540.

Generally, any kind of fluid bladder and/or fluid chamber known in the art could be used. Examples of fluid bladders that may be used in embodiments that include bladder and/or fluid chamber footwear components are disclosed in the following patents and patent applications: Swigart (U.S. Pat. No. 9,161,592), now U.S. patent application Ser. No. 12/938,175, filed Nov. 2, 2010; Chao et al. (U.S. Pat. No. 8,869,430), now U.S. patent application Ser. No. 13/049,278, filed Mar. 16, 2011; Dojan et al. (U.S. Pat. No. 8,789,294), now U.S. patent application Ser. No. 13/049,268, filed Mar. 16, 2011; Hazenberg et al. (U.S. Pat. No. 9,021,720), now U.S. patent application Ser. No. 13/049,256, filed Mar. 16, 2011; Beye et al. (U.S. Pat. No. 8,470,113), now U.S. patent application Ser. No. 12/778,921, filed May 12, 2010; Monfils et al. (U.S. Pat. No. 8,464,439), now U.S. patent application Ser. No. 12/778,909, filed May 12, 2010; Passke, et al. (U.S. Pat. No. 7,210,249); Dojan, et al. (U.S. Pat. No. 7,409,779); Peyton (U.S. Pat. No. 8,479,412), now U.S. patent application Ser. No. 12/630,642; Peyton (U.S. Pat. No. 8,381,418), now U.S. patent application Ser. No. 12/777,167; Schindler (U.S. Pat. No. 7,131,218); Schindler et al. (U.S. Pat. No. 7,588,654); Schindler et al. (U.S. Pat. No. 7,591,919); Mitchell et al. (U.S. Pat. No. 5,713,141); Mitchell et al. (U.S. Pat. No. 5,952,065); Bonk et al. (U.S. Pat. No. 6,082,025); Bonk et al. (U.S. Pat. No. 6,127,026); Bonk et al. (U.S. Pat. No. 6,013,340); Bonk et al. (U.S. Pat. No. 6,203,868); Bonk et al. (U.S. Pat. No. 6,321,465); Rudy (U.S. Pat. No. 4,183,156); Rudy (U.S. Pat. No. 4,219,945); Dua et al. (U.S. Pat. No. 8,151,486), now U.S. patent application Ser. No. 12/123,612; and Rapaport, et al. (U.S. Pat. No. 8,241,451), now U.S. patent application Ser. No. 12/123,646. The entirety of all of the above patents or patent applications are hereby incorporated by reference. Furthermore, the number, geometry and locations of one or more bladders could be varied from one embodiment to another.

Figure 13:
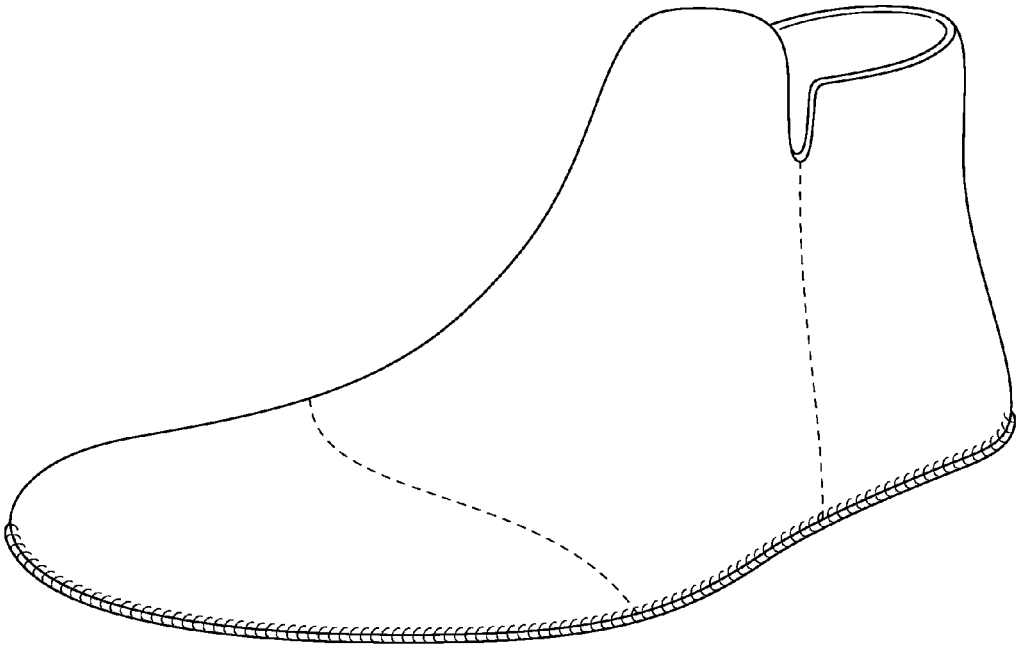
FIG. 13 is a perspective view of an embodiment of an insert having an alternative configuration.

FIG. 13 illustrates a less complicated insert embodiment. It will be noted that the insert shown in FIG. 13 does not include a closure strap. Such a simplified configuration may be suitable for performance insert 171 or heatable/coolable insert 181. In such a strapless embodiment, the insert may have a suitable amount of elasticity to facilitate putting the insert on and taking it off.

Figure 14:
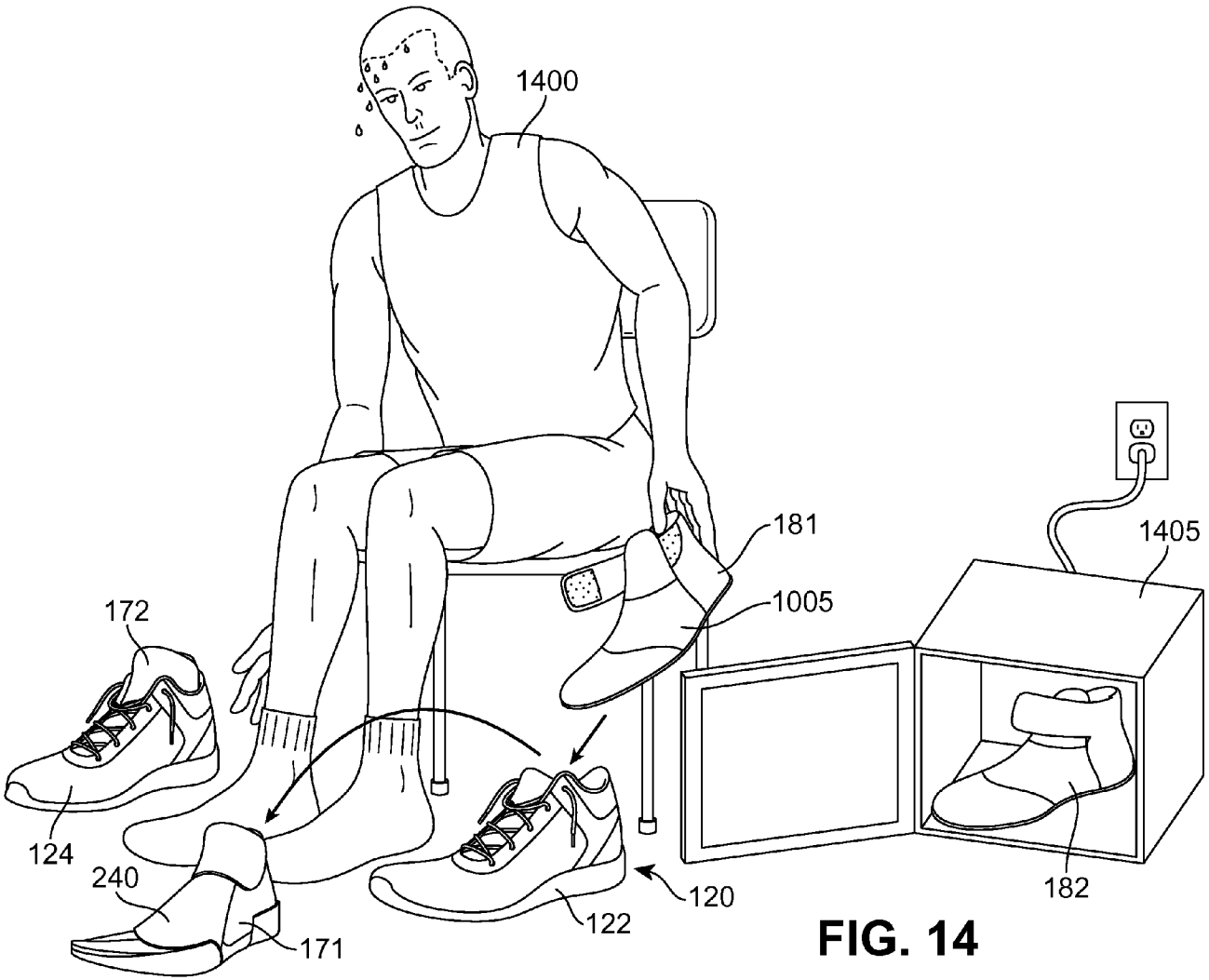
FIG. 14 is a view of a user removing a first insert from a footwear outer assembly and replacing the first insert with a second insert that has been heated or cooled with a thermal transfer device.

FIG. 14 illustrates a method of heat transfer between an article of footwear and the foot of a wearer. As shown in FIG. 14, an athlete 1400 may remove performance inserts 171 and 172 from outer assemblies 122 and 124, respectively, and replace inserts 171 and 172 with inserts 181 and 182. Before inserting inserts 171 and 172, athlete 1400 may transfer heat to, or from, insert 181, for example, using a heat transfer device 1405. In some embodiments, heat transfer device 1405 may be detached from insert 181. Thus, heat may be transferred to or from inserts 171 and 172 via thermal convection, conduction, or radiation.

In FIG. 14, heat transfer device 1405 is illustrated as an electrical cooling device or heating device. For example, heat transfer device 1405 could be cooling device, such as a refrigerator or freezer, or a heating device, such as a microwave oven or conventional oven. Other heating or cooling devices that are detached from the inserts may be suitable for warming or cooling the inserts, and such devices may be powered by any suitable type of power, including electricity, gas, or other types of power sources. Further, in some embodiments, the inserts may be cooled simply by placing the insert in a cooler filled with ice.

It will be noted that, in some cases, a wearer may choose to wear only one heatable/coolable insert at a time. For example, if only one of the wearer's feet is injured, the wearer may choose to use only the heatable/coolable insert corresponding with the injured foot, as the other foot may not warrant treatment. Also, in some embodiments, a kit may include multiple different heatable/coolable inserts. For example, a kit may include a pair of performance inserts, a pair of full-foot heatable/coolable inserts with a high heat capacity material that substantially entirely encapsulate the foot, and a pair of ankle heatable/coolable inserts that contain high heat capacity material only in the ankle region of the insert.

Although the disclosed embodiments illustrate an interchangeable insert system with two different inserts, other embodiments could incorporate a different number of inserts. For example, in some embodiments, three or more inserts could be used, where each insert is configured to provide different footwear characteristics. In still other embodiments, a single insert could be used with an outer assembly. In such embodiments, the insert may be configured to be worn with the outer assembly on a regular basis even when the insert has not been heated or cooled. For example, such an insert may be configured with performance characteristics of normal wear, including athletic activities and/or casual wear, and may have the additional capability of being heated and/or cooled in order to provide further benefits.

The description provided above is intended to illustrate some possible combinations of various features associated with an interchangeable insert system. Those skilled in the art will understand, however, that within each embodiment, some features may be optional. Moreover, different features discussed in different embodiments could be combined in still other embodiments and would still fall within the scope of the attached claims. Some features could be used independently in some embodiments, while still other features could be combined in various different ways in still other embodiments.

While various embodiments have been described, the description is intended to be exemplary, rather than limiting and it will be apparent to those of ordinary skill in the art that many more embodiments and implementations are possible that are within the scope of the embodiments. Accordingly, the embodiments are not to be restricted except in light of the attached claims and their equivalents. Also, various modifications and changes may be made within the scope of the attached claims.

What is claimed is:

1. A footwear system, comprising:

a first insert including a first casing designed to receive a foot of a wearer;

a second insert designed to receive the foot of the wearer, the second insert including a second casing configured to enclose the foot of the wearer, the second casing including a casing material and a high heat capacity material that is configured to remain in a non-solid phase in a working temperature range from approximately 31 degrees Fahrenheit to approximately 99 degrees Fahrenheit; and an outer assembly including an upper portion and an outer sole portion, the outer assembly designed to receive the foot of the wearer while wearing one of the first insert and the second insert;

wherein the first insert is formed completely of one or more materials that are solid in the working temperature range;

wherein the first insert and the second insert are interchangeable such that the outer assembly is designed to:

receive the foot of the wearer when the foot is received within the first insert; and receive the foot of the wearer when the foot is received within the second insert;

wherein substantially all of the first insert is formed by a first plurality of areas;

wherein the second insert is formed, at least in part, by a second plurality of areas that correspond with the first plurality of areas;

wherein, in each area of the first plurality of areas, the first insert has a wall thickness that is substantially the same as a wall thickness of the second insert in an area of the second plurality of areas that corresponds with the area of the first plurality of areas of the first insert; and wherein the second insert is configured to completely enclose the foot of the wearer in order to provide complete encapsulation of the wearer's foot with high heat capacity material.

2. The footwear system of claim 1, wherein the second casing is formed of a plurality of panels.

3. The footwear system of claim 2, wherein each of the plurality of panels include the high heat capacity material.

4. The footwear system of claim 1, wherein the outer assembly has a low cut shoe height and the second insert has a mid-cut or high-top shoe height.

5. The footwear system of claim 1, wherein the high heat capacity material is further configured to remain in a non-solid phase from approximately 99 degrees Fahrenheit to approximately 140 degrees Fahrenheit.

6. The footwear system of claim 1, wherein the high heat capacity material has the consistency of a conformable gel or a flowable fluid in the working temperature range.

7. The footwear system of claim 1, wherein the second casing of the second insert includes a first layer formed of the casing material and a second layer formed of the casing material, the first layer and the second layer defining a cavity therebetween, the cavity containing the high heat capacity material.

8. The footwear system of claim 7, further including a bladder layer disposed within the cavity, the bladder layer providing a barrier to contain the high heat capacity material within the cavity.

9. The footwear system of claim 1, wherein the second casing defines a tongue portion and a fastening member, the fastening member being configured to wrap around the tongue portion.

10. A footwear system, comprising:

a first insert including a first casing configured to at least partially enclose a foot of a wearer;

wherein the first insert is formed completely of one or more materials that are solid in a working temperature range from approximately 31 degrees Fahrenheit to approximately 99 degrees Fahrenheit;

a second insert including a second casing configured to enclose the foot of the wearer, the second casing including a casing material and a high heat capacity material that is configured to remain in a non-solid phase in the working temperature range;

an outer assembly including an upper portion and an outer sole portion, the outer assembly designed to receive the foot of the wearer while wearing one of the first insert and the second insert;

wherein the first insert and the second insert are interchangeable such that the outer assembly is designed to:

receive the foot of the wearer when the foot is received within the first insert; and receive the foot of the wearer when the foot is received within the second insert;

wherein the first casing has a first volume configured to substantially fill a void between the outer assembly and the foot of the wearer, wherein the second casing has a second volume configured to substantially fill the void between the outer assembly and the foot of the wearer, wherein the first volume and the second volume are approximately equal;

wherein the second insert is configured to completely enclose the foot of the wearer in order to provide complete encapsulation of the wearer's foot with high heat capacity material; and wherein the first insert is formed completely of one or more materials that are solid in the working temperature range.

11. The footwear system of claim 1, wherein the high heat capacity material is further configured to remain in a non-solid phase from approximately 99 degrees Fahrenheit to approximately 140 degrees Fahrenheit.

12. The system of claim 10, wherein substantially all of the first insert is formed by a first plurality of areas;

wherein the second insert is formed, at least in part, by a second plurality of areas that correspond with the first plurality of areas; and wherein, in each area of the first plurality of areas, the first insert has a wall thickness that is substantially the same as a wall thickness of the second insert in an area of the second plurality of areas that corresponds with the area of the first plurality of areas of the first insert.

13. The system of claim 10, wherein the second casing defines a tongue portion and a fastening member, the fastening member being configured to wrap around the tongue portion.

14. The system of claim 10, wherein the high heat capacity material is contained within the casing material of the second casing of the second insert.

15. The system of claim 14, wherein the second casing includes a first layer formed of the casing material and a second layer formed of the casing material, the first layer and the second layer defining a cavity therebetween, the cavity containing the high heat capacity material.

16. The system of claim 15, further including a bladder layer disposed within the cavity, the bladder layer providing a barrier to contain the high heat capacity material within the cavity.

17. The system kit of claim 10, wherein the second casing is formed of a plurality of panels; wherein each of the plurality of panels include the high heat capacity material.

18. The system of claim 10, wherein the outer assembly has a low cut shoe height and the second insert has a mid-cut shoe height.

19. The system of claim 10, wherein the outer assembly has a low cut shoe height and the second insert has a high-top shoe height.

20. The system of claim 10, wherein the first insert is configured to cover a different surface area of the foot than the second insert.

21. A method of heat transfer between an article of footwear and the foot of a wearer, comprising:

providing a first insert configured to receive the foot of the wearer and formed completely of one or more materials that are solid in a working temperature range from approximately 31 degrees Fahrenheit to approximately 99 degrees Fahrenheit;

providing a second insert that is interchangeable with the first insert;

providing an outer assembly including an upper portion and an outer sole portion, the outer assembly designed to receive the foot of the wearer while wearing one of the first insert and the second insert;

wherein the first insert is provided within the outer assembly, the first insert including a first casing designed to receive the foot of the wearer while disposed within the outer assembly;

removing the first insert from the outer assembly;

transferring heat to, or from, the second insert using a heat transfer device that is detached from the second insert, wherein the second insert is designed to receive the foot of the wearer while disposed within the outer assembly, and wherein the second insert includes a second casing configured to at least partially enclose the foot of the wearer, the second casing including a casing material and a high heat capacity material that is configured to remain in a non-solid phase in the working temperature range;

wherein the second insert is configured to completely enclose the foot of the wearer in order to provide complete encapsulation of the wearer's foot with high heat capacity material;

inserting the second insert into the outer assembly; and inserting the foot into the second insert while the second insert is disposed inside the outer assembly.

22. The method of claim 21, wherein the heat transfer device includes a microwave oven.

23. The method of claim 21, wherein the heat transfer device includes a refrigerator or freezer.

24. The method of claim 21, wherein the first casing defines a first volume configured to substantially fill a void between the outer assembly and the foot of the wearer, wherein the second casing has a second volume configured to substantially fill a void between the outer assembly and the foot of the wearer, wherein the first volume and the second volume are approximately equal.

25. The method of claim 21, wherein substantially all of the first insert is formed by a first plurality of areas;

wherein the second insert is formed, at least in part, by a second plurality of areas that correspond with the first plurality of areas; and wherein, in each area of the first plurality of areas, the first insert has a wall thickness that is substantially the same as a wall thickness of the second insert in an area of the second plurality of areas that corresponds with the area of the first plurality of areas of the first insert.

* * * * *